US011319036B2

(12) United States Patent
Duggal et al.

(10) Patent No.: US 11,319,036 B2
(45) Date of Patent: May 3, 2022

(54) MOORING SYSTEMS AND PROCESSES FOR USING SAME

(71) Applicant: SOFEC, INC., Houston, TX (US)

(72) Inventors: Arun Sanjay Duggal, Houston, TX (US); Yonghui Liu, Houston, TX (US); Yu Ding, Houston, TX (US)

(73) Assignee: SOFEC, INC., Houston, TX (US)

( * ) Notice: Subject to any disclaimer, the term of this patent is extended or adjusted under 35 U.S.C. 154(b) by 0 days.

(21) Appl. No.: 17/482,814

(22) Filed: Sep. 23, 2021

(65) Prior Publication Data

US 2022/0001963 A1 Jan. 6, 2022

Related U.S. Application Data

(63) Continuation of application No. PCT/US2020/046803, filed on Aug. 18, 2020.
(Continued)

(51) Int. Cl.

| | |
|---|---|
| ***B63B 39/02*** | (2006.01) |
| ***B63B 21/50*** | (2006.01) |
| ***B63B 21/00*** | (2006.01) |

(52) U.S. Cl.
CPC ..... *B63B 39/02* (2013.01); *B63B 21/502* (2013.01); *B63B 2021/002* (2013.01)

(58) Field of Classification Search
CPC . B63B 21/00; B63B 2021/001; B63B 21/002; B63B 21/003; B63B 21/502;
(Continued)

(56) References Cited

U.S. PATENT DOCUMENTS

| | | | |
|---|---|---|---|
| 4,088,089 | A | 5/1978 | Flory |
| 4,114,556 | A | 9/1978 | Orndorff, Jr. et al. |

(Continued)

FOREIGN PATENT DOCUMENTS

| | | | |
|---|---|---|---|
| EP | 0298559 | | 1/1989 |
| EP | 0337531 | A1 | 10/1989 |

(Continued)

OTHER PUBLICATIONS

International Search Report and Written Opinion for International Application No. PCT/US2020/046803 dated Nov. 30, 2020.
(Continued)

*Primary Examiner* — Daniel V Venne
(74) *Attorney, Agent, or Firm* — Edmonds & Cmaidalka, P.C.

(57) ABSTRACT

Mooring systems and processes for using same. In some embodiments, the system can include a first vessel support structure and a second vessel support structure, each disposed on a vessel. Each vessel support structure can include at least one extension arm can be suspended from each vessel support structure. A ballast tank can be connected to each of the at least one extension arms. A first end of a yoke can be connected to the ballast tank and a second end of the yoke can include a yoke head disposed thereon. The system can also include a first mooring support structure and a second mooring support structure, each fixed in place. Each mooring support structure can include a pitch bearing. The yoke heads of the first and second vessel support structures can be connected to the pitch bearings of the first and second mooring support structures, respectively.

20 Claims, 19 Drawing Sheets

Related U.S. Application Data

(60) Provisional application No. 62/888,940, filed on Aug. 19, 2019.

(58) Field of Classification Search
CPC ..... B63B 21/507; B63B 39/00; B63B 39/02; B63B 39/03
USPC ..... 114/114, 121, 124, 125; 441/3
See application file for complete search history.

(56) References Cited

U.S. PATENT DOCUMENTS

| | | | | |
|---|---|---|---|---|
| 4,119,051 | A | 10/1978 | Orndorff, Jr. | |
| 4,191,256 | A | 3/1980 | Croy et al. | |
| 4,516,942 | A | 5/1985 | Pedersen | |
| 4,530,302 | A * | 7/1985 | Pedersen | B63B 22/025 114/230.15 |
| 4,568,295 | A | 2/1986 | Poldervaart | |
| 5,884,576 | A | 3/1999 | Wajnikonis | |
| 6,227,135 | B1 | 5/2001 | Pedersen | |
| 6,851,994 | B2 * | 2/2005 | Boatman | B63B 27/24 114/230.15 |
| 6,923,225 | B2 | 8/2005 | Poldervaart et al. | |
| 7,007,623 | B2 | 3/2006 | Boatman et al. | |
| 7,516,713 | B1 | 4/2009 | Franta | |
| 8,104,417 | B1 | 1/2012 | Shivers, III et al. | |
| 8,308,517 | B1 * | 11/2012 | Shivers, III | B63B 21/50 441/4 |
| 8,568,076 | B1 * | 10/2013 | Harris | B63B 27/34 414/137.9 |
| 8,763,549 | B2 | 7/2014 | Liu et al. | |
| 9,573,659 | B2 | 2/2017 | Liu et al. | |
| 2001/0029879 | A1 | 10/2001 | Cottrell et al. | |
| 2003/0226487 | A1 | 12/2003 | Boatman et al. | |
| 2004/0094082 | A1 | 5/2004 | Boatman et al. | |
| 2005/0106959 | A1 | 5/2005 | Storvoll et al. | |
| 2010/0326667 | A1 | 12/2010 | Coppens | |
| 2014/0014017 | A1 | 1/2014 | Balleraud et al. | |
| 2014/0034137 | A1 | 2/2014 | Kelly et al. | |
| 2017/0113762 | A1 | 4/2017 | Lindblade | |

FOREIGN PATENT DOCUMENTS

| | | |
|---|---|---|
| EP | 1826116 A1 | 8/2007 |
| EP | 2070812 | 6/2009 |
| EP | 2646725 | 10/2013 |
| GB | 1595045 A | 8/1981 |
| WO | 03076262 | 9/2001 |
| WO | 20060065130 | 6/2006 |
| WO | 2012123191 | 9/2012 |
| WO | 2015041916 | 3/2015 |
| WO | 2015055327 | 4/2015 |
| WO | 2015126320 | 8/2015 |
| WO | 201911244 A1 | 6/2019 |

OTHER PUBLICATIONS

International Search Report and Written Opinion for International Application No. PCT/US2016/058149, dated Dec. 2, 2016.
International Search Report and Written Opinion for International Application No. PCT/US2020/026586 dated Jul. 22, 2020.
International Search Report and Written Opinion for International Application No. PCT/US2020/026572 dated Jul. 20, 2020.
Third-Party Observations from EPO for European Patent Application No. 16860549.1 dated Nov. 5, 2020.
A challenging mating operation between VLCC class FPSO and soft yoke mooring system in extremely shallow water, conference paper, Texas, USA, publication date Apr.-May 2012.

* cited by examiner

MOORING SYSTEMS AND PROCESSES FOR USING SAME

CROSS-REFERENCE TO RELATED APPLICATIONS

This application is a continuation of International Application No. PCT/US2020/046803, filed on Aug. 18, 2020, and published as WO 2021/034828, which claims priority to U.S. Provisional Patent Application No. 62/888,940, filed on Aug. 19, 2019, which are both incorporated by reference herein.

BACKGROUND

Field

Embodiments described herein generally relate to mooring systems and processes for using same. More particularly, such embodiments relate to a stabilized mooring system for a floating vessel or facility, such as a floating structure for storage and/or hydrocarbon production.

Description of the Related Art

In the processing and storage of offshore oil and gas, mooring systems have been used to connect floating production, storage, and offloading (FPSO) vessels, floating storage and offloading (FSO) vessels, and other floating vessels or facilities to various tower structures in the open sea and near-shore. Some conventional near-shore mooring systems are permanent, meaning the connected vessel can be maintained in a relatively fixed position over many years. Many such near-shore permanent mooring systems are dependent on a site where severe weather can be mitigated. For example, the site might be protected by a jetty or other physical structure locally available or purposefully constructed to protect the permanently moored vessel during harsh weather conditions. Other conventional mooring systems are not permanent and are disconnectable, allowing vessels to leave the field, such as to avoid severe weather events and conditions like harsh seas, typhoons, hurricanes, and icebergs.

Conventional mooring systems used to maintain a vessel in a relatively fixed position include spread mooring systems and the traditional jetty or mooring dolphin systems. The spread mooring systems have a significant drawback because such mooring systems require a very large footprint for the mooring lines. For example, some spread mooring systems can include mooring lines extending away from the moored vessel for a half a mile or more. Spread mooring systems are also incapable of mooring a vessel close to a breakwater, jetty, or other physical structure due to the large footprint. Additionally, the water above spread mooring systems is generally considered a no pass zone for other vessels. The traditional jetty or mooring dolphin systems can maintain a vessel in close proximity to a breakwater, jetty, or other physical structure, but are rather susceptible to relatively minor weather events such as storms.

To be safely used in areas near physical structures, e.g., breakwaters, jetties, or other structures, which are also subject to more extreme conditions, it is highly desirable to have a more robust mooring system that can secure a vessel in a relatively fixed position, close to a physical structure, while also being able to maintain the vessel in position without external intervention during extreme weather conditions.

SUMMARY

The present disclosure provides mooring systems and processes for using same to secure a floating vessel in a stabilized mooring position. In some embodiments, the system for securing a vessel floating on a surface of a body of water in a stabilized position, can include a first vessel support structure and a second vessel support structure, each disposed on the vessel. Each vessel support structure can include one or more extension arms, each having a first end and a second end, where the first end of the one or more extension arms is suspended from the vessel support structure. A ballast tank can be connected to the second end of the one or more extension arms. Each vessel support structure can also include a yoke having a first end and a second end. The first end of the yoke can be connected to the ballast tank and the second end can include a yoke head disposed thereon. The system can also include a first mooring support structure and a second mooring support structure, each fixed in place. Each mooring support structure can include a pitch bearing. The yoke head of the first vessel support structure can be connected to the pitch bearing of the first mooring support structure. The pitch bearing of the first mooring support structure can be configured to allow the yoke of the first vessel support structure to pivot about a horizontal axis relative to the first mooring support structure. The yoke head of the second vessel support structure can be connected to the pitch bearing of the second mooring support structure. The pitch bearing of the second mooring support structure can be configured to allow the yoke of the second vessel support structure to pivot about a horizontal axis relative to the second mooring support structure. The system can be configured to provide restoring forces between the first and second mooring support structures and the floating vessel in response to external environmental forces acting on the vessel.

In other embodiments, the system for securing a vessel floating on a surface of a body of water in a stabilized position, can include a first mooring support structure and a second mooring support structure, each fixed in place. Each mooring support structure can include one or more extension arms, each having a first end and a second end, where the first end of the one or more extension arms is suspended from the mooring support structure. A ballast tank can be connected to the second end of the one or more extension arms. Each mooring support structure can also include a yoke having a first end and a second end, the first end connected to the ballast tank and the second end can include a yoke head disposed thereon. The system can also include a first vessel support structure and a second vessel support structure, each disposed on the vessel. Each vessel support structure can include a pitch bearing. The yoke head of the first mooring support structure can be connected to the pitch bearing of the first vessel support structure. The pitch bearing of the first vessel support structure can be configured to allow the yoke of the first mooring support structure to pivot about a horizontal axis relative to the first vessel support structure. The yoke head of the second mooring support structure can be connected to the pitch bearing of the second vessel support structure. The pitch bearing of the second vessel support structure can be configured to allow the yoke of the second mooring support structure to pivot about a horizontal axis relative to the second vessel support structure. The system can be configured to provide restoring forces between the first and second mooring support structures and the floating vessel in response to external environmental forces acting on the vessel.

BRIEF DESCRIPTION OF THE DRAWINGS

The various aspects and advantages of the preferred embodiment of the present invention will become apparent to those skilled in the art upon an understanding of the following detailed description of the invention, read in light of the accompanying drawings which are made a part of this specification.

DETAILED DESCRIPTION

Figure 1:
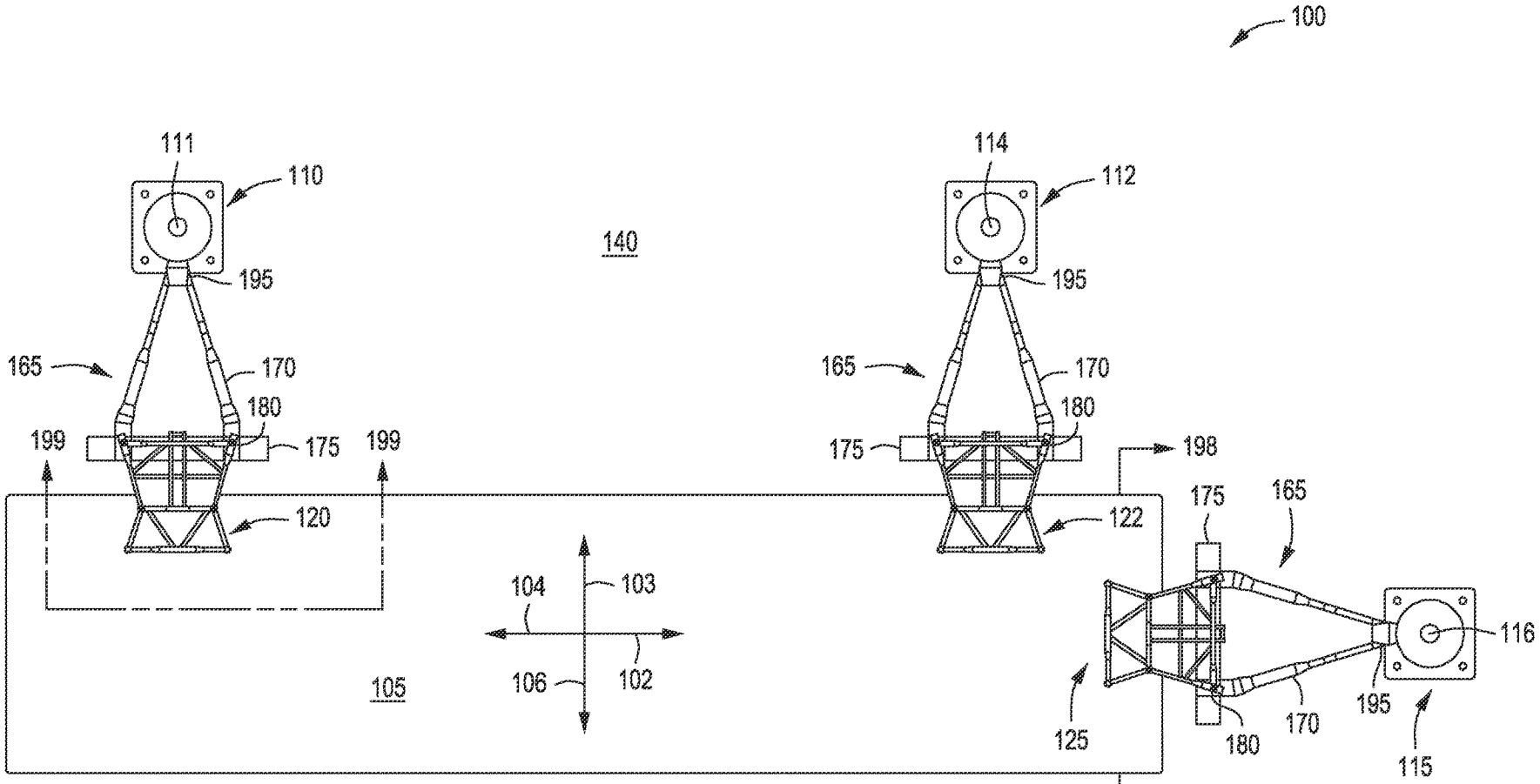
FIG. 1 depicts a schematic of an illustrative system securing a vessel to a plurality of mooring support structures by a plurality of yoke mooring systems (YMS), according to one or more embodiments described.

A detailed description will now be provided. Each of the appended claims defines a separate invention, which for infringement purposes is recognized as including equivalents to the various elements or limitations specified in the claims. Depending on the context, all references to the "invention", in some cases, refer to certain specific or preferred embodiments only. In other cases, references to the "invention" refer to subject matter recited in one or more, but not necessarily all, of the claims. It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the Figures. Moreover, the formation of a first feature over or on a second feature in the description that follows includes embodiments in which the first and second features are formed in direct contact and also includes embodiments in which additional features are formed interposing the first and second features, such that the first and second features are not in direct contact. The exemplary embodiments presented below may be combined in any combination of ways, i.e., any element from one exemplary embodiment may be used in any other exemplary embodiment, without departing from the scope of the disclosure. The figures are not necessarily drawn to scale and certain features and certain views of the figures can be shown exaggerated in scale or in schematic for clarity and/or conciseness.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Also, the naming convention used herein is not intended to distinguish between components that differ in name but not function. Furthermore, in the following discussion and in the claims, the terms "including" and "comprising" are used in an open-ended fashion, and thus should be interpreted to mean "including, but not limited to."

All numerical values in this disclosure are exact or approximate values ("about") unless otherwise specifically stated. Accordingly, various embodiments of the disclosure may deviate from the numbers, values, and ranges disclosed herein without departing from the intended scope.

Further, the term "or" is intended to encompass both exclusive and inclusive cases, i.e., "A or B" is intended to be synonymous with "at least one of A and B," unless otherwise expressly specified herein. The indefinite articles "a" and "an" refer to both singular forms (i.e., "one") and plural referents (i.e., one or more) unless the context clearly dictates otherwise. The terms "up" and "down"; "upward" and "downward"; "upper" and "lower"; "upwardly" and "downwardly"; "above" and "below"; and other like terms used herein refer to relative positions to one another and are not intended to denote a particular spatial orientation since the apparatus and methods of using the same may be equally effective at various angles or orientations.

Each of the inventions will now be described in greater detail below, including specific or preferred embodiments, versions and examples, but the inventions are not limited to these embodiments, versions or examples, which are provided to enable a person having ordinary skill in the art to make and use the inventions, when the information in this disclosure is combined with publicly available information and technology.

FIG. 1 depicts a schematic of an illustrative mooring system 100 and vessel 105, according to one or more embodiments. The vessel 105 can be secured in a relatively stabilized mooring position facing any heading. For example, the relatively stabilized mooring position can be when the vessel 105 is secured such that an aft portion 102 and a starboard portion 103 of the vessel 105 can be held for days, weeks, months, or years in many or all environmental conditions in a direction approximately facing one of a selection of magnetic compass points chosen from north, south, east, west, or any magnetic compass point therebetween. The vessel 105 can be secured in the stabilized mooring position adjacent a shoreline and/or a pier (not shown) in relatively shallow water and/or waters having various depths. Shallow water is herein defined as water having a depth of about 15 meters to about 100 meters or less, e.g., about 15 meters to about 75 meters or about 15 meters to about 50 meters.

The mooring system 100 can include two or more mooring support structures (three are shown) 110, 112, 115 and two or more vessel support structures (three are shown) 120, 122, 125. The vessel support structures 120, 122, 125 can be located or otherwise disposed on the vessel 105. The vessel support structures 120, 122, 125 can be disposed at the bow, stern or on a side of the vessel 105. For example, the vessel support structures 120, 122, 125 can be disposed on a deck (shown) or other surface of the vessel (not shown), e.g., an exterior side of the hull of the vessel. Although the vessel support structure 120 is depicted as being located at a first starboard side 103 portion of the vessel 105, the vessel support structure 122 is depicted as being located at a second starboard side 103 portion of the vessel 105, and the vessel support structure 125 is depicted as being located at an aft 102 portion proximate a center of the vessel 105 between the starboard 103 and port 106 sides of the vessel 105; the vessel support structures 120, 122, 125 can be located anywhere about the vessel 105. In one embodiment, at least one vessel support structure, e.g., vessel support structure 120, can be located at a bow 104 portion of the vessel 105 between the starboard 103 and port 106 sides of the vessel. The vessel support structures 120, 122, 125 can include connection points for connection above and/or below the water line. The vessel support structures 120, 122, 125 can be retrofitted or otherwise connected to the vessel 105.

Each mooring support structure 110, 112, 115 can be located adjacent a corresponding vessel support structure 120, 122, 125, which can be adjacent to the vessel 105 and fixed in place. In one embodiment, one or more or the mooring support structures 110, 112, 115 can be fixed to a seabed 140 via one or more pilings or can be floating and anchored and/or moored to other structures (not shown) to form respective mooring anchor locations 111, 114, 116. In another embodiment, one or more of the mooring support structures 110, 112, 115 can be fixed to or fixed in close proximity to a structure above the water or partially submerged in the water such as a coastal defense structure. Coastal defense structures can be or can include, but are not limited to, a jetty, a groin, a seawall, a breakwater, a pipeline trestle/jetty.

In the stabilized mooring position, the mooring anchor locations 111, 114, 116 can be located within about 200 meters, about 100 meters, about 90 meters, about 80 meters, about 70 meters, about 60 meters, about 50 meters, about 40 meters, about 30 meters, about 20 meters, about 10 meters, or less, or various distances therebetween, of a hull surface or perimeter of the vessel 105. Although the mooring anchor locations 111, 114, 116 are shown at some distance from a side of the vessel 105, one or more of the mooring anchor locations 111, 114, 116 can be under the vessel 105. One or more of the mooring anchor locations 111, 114, 116 can be located anywhere within a plane that intersects both the vessel 105 and the mooring anchor locations 111, 114, 116. As such, other floating vessels and other watercraft, e.g., a submarine, can freely traverse through the water at a distance just outside the mooring anchor locations 111, 114, 116. For example, if the mooring anchor locations 111, 114, and 116 are about 100 meters or less from the moored vessel, other watercraft can freely traverse through the water at a distance greater than about 100 meters without any concern of striking or otherwise contacting any component of the mooring system 100. Said another way, a maximum distance any portion of the mooring system extends away from a side or perimeter of the vessel 105, the mooring footprint, can be about 100 meters or less. The mooring footprint about vessel 105 can be different. For example, on one side of the vessel 105, the mooring footprint can be less than 25 meters while on another side of the vessel 105, the mooring footprint can be between 50 meters and 100 meters.

Located, attached, joined, connected to, or otherwise suspended between the mooring support structures 110, 112, 115 and the corresponding vessel support structures 120, 122, 125 can be a yoke mooring system (YMS) 165. Each YMS 165 can include a yoke 170 having a first end and a second end. The first end of the yoke 170 can be connected to a ballast tank 175 and the second end of the yoke 170 can include a yoke head 195. Each YMS 165 can also include one or more link or extension arms 180 connected to the ballast tank 175. It should be understood that while each YMS 165 is shown as having substantially the same configuration and dimensions, each YMS 165 can be designed with different configurations and dimensions. It should also be understood that while each YMS 165 is shown and described as having a ballast tank 175, one or more of the YMS 165 can include a weight having a fixed mass instead of the ballast tank 175. For example, in one or more embodiments, one or more of the ballasts tanks 175 can be replaced with a solid body of metal or other material having a fixed mass.

The yoke 170 can be any elongated structure with sufficient strength to join the vessel 105 to an adjacent structure, such as the mooring support structure 115. In one embodiment, the yoke 170 can be formed from one or more tubular members (411, 412 shown in FIGS. 4A, 5, and 8). Each tubular member can have a circular, squared, or other polygonal cross-sectional shape. In certain embodiments, the yoke 170 can have two legs arranged in a "V" shape that are connected to the ballast tank 175 at one end and connected with the yoke head 195 at the other end. When connected, the ballast tank 175, extension arms 180, and yoke 170 can form a triangular shaped frame. As explained in more detail below, the ballast tank 175, extension arms 180 and yoke 170 can provide a restoring force between the mooring support structures 110, 112, and 115 and the vessel 105.

The ballast tank 175 can be any container, drum or the like capable of holding water, high density concrete blocks, drilling mud, sand, gravel, rocks, or other ballast. The ballast tank 175 can be connected to the yoke 170 and the extension arm(s) 180. The ballast tank 175 can serve as a counterbalance or restoring force as the vessel 105 moves at sea. The ballast tank 175 can be connected to the vessel support structure 125 via the one or more extension arms 180.

The extension arms 180 can be or include one or more jointed sections that are mechanically connected together. The extension arms 180 can be rigid or flexible. The extension arms 180 can be or can include metal pipe or other tubular members, wire, cable, chain, metal rods, or the like.

In some embodiments, each YMS 165 can be attached, joined, connected to, or otherwise suspended from the vessel support structures 120, 122, 125. In other embodiments, each YMS 165 can be attached, joined, connected to, or otherwise suspended from the mooring support structures 110, 112, 115. In still other embodiments, one or more YMS 165 can be attached, joined, connected to, or otherwise suspended from one or more of the vessel support structures 120, 122, 125 and one or more YMS 165 can be attached, joined, connected to, or otherwise suspended from one or more of the mooring support structures 110, 112, 115. In other embodiments, one or more of the YMS 165 can be replaced with a duplex yoke mooring system, not shown. Suitable duplex yoke mooring systems can include the duplex yoke mooring system disclosed in U.S. Pat. No. 7,073,457.

In operation, connecting one YMS 165 to one vessel support structure 120, 122, 125 and one mooring support structure 110, 112, 115 can be performed at the same time or at different times and in the same way or different ways. In one embodiment, the yoke head 195 of a first YMS 165 can be connected to a first mooring support structure 110, 112, 115 while the vessel 105 is brought into position and then a first extension arm 180 of the first YMS 165 can be connected to a first vessel support structure 120, 122, 125 through the use of one or more ropes, chains, winches, other lifting devices, and/or support vessels, not shown, on the first vessel support structure 120, 122, 125 to support lifting the extension arms 180 into appropriate alignment and then connecting the extension arms 180 to the first vessel support structure 120, 122, 125. The extension arms 180 of a second YMS 165 can be connected to a second mooring support structures 110, 112, 115 while the vessel 105 is brought into position and then the yoke head 195 of the second YMS 165 can be connected to a second vessel support structures 120, 122, 125 through the use of one or more ropes, chains, winches, other lifting devices, and/or support vessels, not shown, on the second vessel support structure 120, 122, 125 to support lifting the yoke head 195 into appropriate alignment and then connecting the yoke head 195 to the second vessel support structure 120, 122, 125. In another embodiment, the yoke head 195 of a first YMS 165 suspended from a vessel support structure 120, 122, 125 via the one or more extension arms 180 can be connected to a first mooring support structure. In another embodiment, the yoke head 195 of a first YMS 165 suspended from a mooring support structure 110, 112, 115 via the one or more extension arms 180 can be connected to a first vessel support structure 120, 122, 125. Disconnection of the one or more YMSs 165 can be performed in a similar reverse fashion.

Each vessel support structure 120, 122, 125, each mooring support structure 110, 112, 115, and each associated YMS 165 can be the same configuration or different configurations. Several illustrative YMS 165, vessel support structure 120, 122, 125 and mooring support structure 110, 112, 115 configurations are provided below, for example with reference to the section views 198, 199, and 1310.

The term "vessel" refers to any type of floating structure including but not limited to tankers, boats, ships, FSOs, FPSOs, FLNGs, FSRUs, and the like. It should be appreciated by those skilled in the art that the YMS 165 can be mounted on converted vessels as well as new-built vessels.

Figure 2:
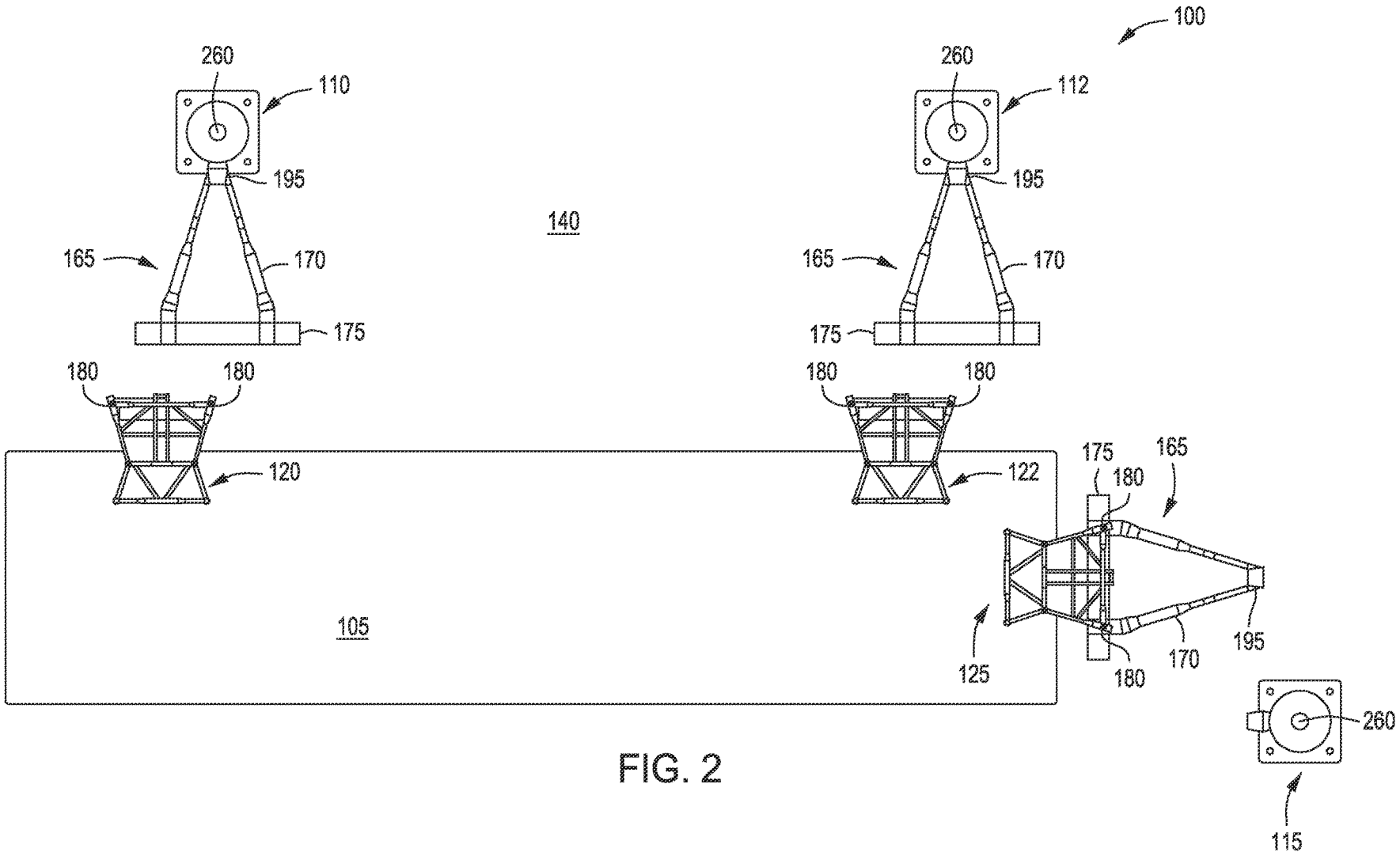
FIG. 2 depicts a schematic of the system depicted in FIG. 1, prior to the vessel being moored in the stabilized mooring position.

FIG. 2 depicts a schematic of the mooring system 100 and vessel 105 depicted in FIG. 1, prior to the vessel 105 being moored in the stabilized mooring position, according to one or more embodiments. The vessel 105 can float in and be moored in shallow water. Each yoke head 195 can be connected to a corresponding mooring support structure 110, 112, 115 or to a corresponding vessel support structure 120, 122, 125 via a respective turntable 260 disposed on the corresponding mooring support structure 110, 112, 115 or the corresponding vessel support structure 120, 122, 125. In some embodiments, one or more of the turntables 260 can be configured to or adapted to have a rotational travel that is limited to less than plus or minus one-hundred and eighty degrees. The rotational travel of the one or more turntables 260 can be configured to or adapted to be limited to less than plus or minus ninety degrees, plus or minus forty-five degrees, plus or minus thirty degrees, plus or minus fifteen degrees, or any rotational travel limitations therebetween. To limit the rotational travel of the one or more turntables 260, the one or more turntables 260 can include mechanical stops, shock absorbers, springs, chains, cables, electric motors, hydraulic cylinders, or combinations thereof. In some embodiments, the turntables 260 disposed on the mooring support structures 110, 112, 115 or the vessel support structures 120, 122, 125 can be configured to or can be adapted to freely rotate about a full three hundred and sixty degree radius but their rotational travel can be limited to less than plus or minus one-hundred and eighty degrees when the mooring system 100 includes two or more mooring support structures 110, 112, 115 and two or more vessel support structures 120, 122, 125 connected with one another. In other embodiments, one or more turntables 260 can be replaced with a fixed or static connection point. As such, in some embodiments, the mooring system 100 can be free of any turntable 260.

In some embodiments, at least one yoke head 195 can be limited in its rotational travel about the mooring support structure 110, 112, 115 or the vessel support structure 120, 122, 125 that the at least one yoke head 195 is connected. In other embodiments, each extension arm 180 can be connected to each vessel support structure 120, 122, 125, as depicted, or each mooring support structure 110, 112, 115. The connection can be via the turntable 260 that can be disposed on each mooring support structure 110, 112, 115, as depicted, or each vessel support structure 120, 122, 125, as described herein. At least one extension arm 180 can be connected to at least one turntable 260 configured to or adapted to have a limited rotational travel as described above. The at least one extension arm 180 can be similarly limited in its rotational travel about the mooring support structure 110, 112, 115 or the vessel support structure 120, 122, 125 the at least one extension arm 180 is connected to.

During mooring operations, the vessel 105 can be moved over water toward the mooring support structures 110, 112, 115 such that each YMS 165 can be connected between corresponding support structures 110, 112, 115 and vessel support structures 120, 122, 125. To connect a first YMS 165, a first yoke head 195, can be connected to a first mooring support structure 110, 112, 115 or a first vessel support structure 120, 122, 125, and/or one or more first extension arms 180 can be connected to the first mooring support structure 110, 112, 115 or the first support structure 120, 122, 125. A first ballast tank 175 can be configured to provide one or more restoring forces between the first mooring support structure 110, 112, 115 and the first vessel support structure 120, 122, 125. In some embodiments, the restoring force can be or can include, but is not limited to, a stiffness force, a dampening of motion, a tension or pulling force, a vertical force, a horizontal force, a rotational force, or other restorative-type force. For example, the first ballast tank 175 can be configured to provide stiffness or restoring forces in a horizontal plane to control the motions of the vessel between the first mooring support structure 110, 112, 115 and the first vessel support structure 120, 122, 125. One or more additional YMS 165 connections or attachments can be completed via a similar process.

Figure 3:
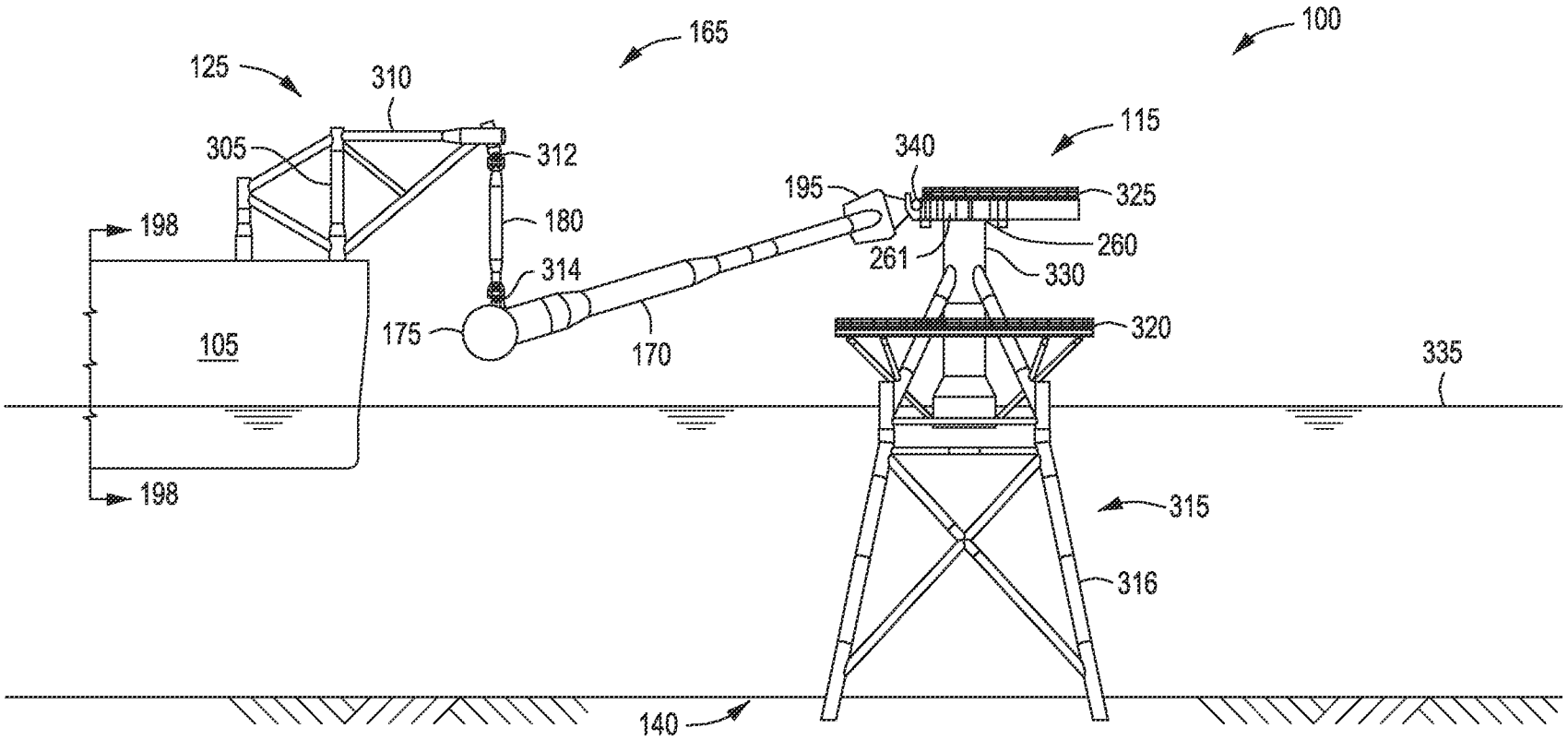
FIG. 3 depicts a schematic side elevation section view of the system and vessel depicted in FIG. 1, showing an embodiment in which the YMS is connected to a raised mooring support structure.

FIG. 3 depicts a schematic side elevation section view 198 of the mooring system 100 and vessel 105 depicted in FIG. 1, depicting the YMS 165 connected to a raised framed structure 315 for securing the vessel 105 in the stabilized mooring position, according to one or more embodiments. The vessel support structure 125 can be a raised tower or other framed structure. The vessel support structure 125 can be enclosed within a housing, not shown. The vessel support structure 125 can include a generally vertical section 305 and a generally horizontal section 310. The generally horizontal section 310 can be cantilevered. The generally horizontal section 310 can extend beyond the bow of the vessel 105. The generally horizontal section 310 can help support the weight of the yoke 170 and the ballast tank 175.

The YMS 165 can be connected to the vessel support structure 125, as depicted in FIG. 3, or as described further below to the mooring support structure 115. In some embodiments, the one or more extension arms 180 can be connected to the generally horizontal section 310 of the vessel support structure 125 via one or more upper U-joints 312. The extension arms 180 can also be connected to the ballast tank 175 using one or more lower U-joints 314. The upper U-joints 312 and lower U-joints 314 can each be single-axis, double-axis, triple-axis, or any type of joint allowing multiple degrees of freedom about the attachment or connection points between the U-joints 312, 314 and the ballast tank 175. The vessel support structure 125 can suspend the extension arms 180 and the ballast tank 175. The U-joints 312, 314 are provided as one type of coupler that can be used, however, any type of coupling that permits angular movement between its connections can be equally employed.

The mooring support structure 115 can be a raised tower or other framed structure 315 and can include a base or jacket structure 316 that can be piled into the seafloor 140 or connected to the one or more pilings or piling foundations, not shown. One or more decks 320, 325 (two are shown) can be disposed about and/or on a support column 330 at various elevations above and/or below the water line 335. In some embodiments, the decks 320, 325 can be configured or adapted to support various processing equipment, manifolds, etc. In some embodiments, the base 316 can be fixedly connected to a dock or other man-made structure, land above sea-level, land below sea-level, and/or combinations thereof.

The raised framed structure 315 can further include the turntable 260 disposed on the support column 330. The turntable 260 can include one or more bearings 261. In some embodiments, the bearing 261 can be a roller bearing, a slide bearing, or any other suitable bearing. The bearing 261 can be metallic or synthetic. In some embodiments, the bearing 261 can be self-lubricating. The rotational travel of turntable 260 and the bearing 261 can be configured to or adapted to be limited such that the vessel 105 connected with the mooring support structure 115 can only rotate about the turntable 260 less than plus or minus one-hundred and eighty degrees. The rotational travel of the bearing 261 can be configured to or adapted to be limited to less than plus or minus ninety degrees, plus or minus forty-five degrees, plus or minus thirty degrees, plus or minus fifteen degrees, or any rotational travel limitations therebetween including eliminating all rotational travel about the turntable 260. To limit the rotational travel of the bearing 261, the bearing 261 can include mechanical stops, shock absorbers, springs, chains, cables, electric motors, hydraulic cylinders and/or combinations thereof. In some embodiments, one or more additional decks, not shown, can be located above the turntable 260 and can be able to rotate with the turntable 260.

The yoke head 195 can be connected to the mooring support structure 115 and/or turntable 260 via one or more joints, connectors, or bearings 340. The one or more joints, connectors, or bearings 340 can allow for pivotal or multi-directional axial articulation and/or rotation between the yoke head 195 and the turntable 260. The yoke head 195 can be a unitary conical or frusto-conical element permanently connected, e.g., welded, to the one or more joints, connectors, or bearings 340. In some embodiments, the joint, connector, or bearing 340 can be or can include a pitch bearing configured to allow the yoke 170 to pivot about a horizontal axis relative to the mooring support structure 115. In other embodiments, the joint, connector, or bearing 340 can be or can include a pitch bearing and a roll bearing, the pitch bearing configured to allow the yoke 170 to pivot about a horizontal axis relative to the mooring support structure 115 and the roll bearing configured to allow the yoke 170 to rotate relative to the mooring support structure 115 along a longitudinal axis of the yoke head 195. In other embodiments, the joint, connector, or bearing 340 can be or can include a pitch bearing configured to allow yoke 170 to pivot about a horizontal axis relative to the mooring support structure 115 and the yoke head 195 can include a roll bearing configured to allow the yoke 170 to rotate relative to the mooring support structure 115 along a longitudinal axis of the yoke head 195. In other embodiments, the connection between the yoke head 195 to the mooring support structure can form a roll bearing as further described below regarding FIGS. 23-26.

Figure 4:
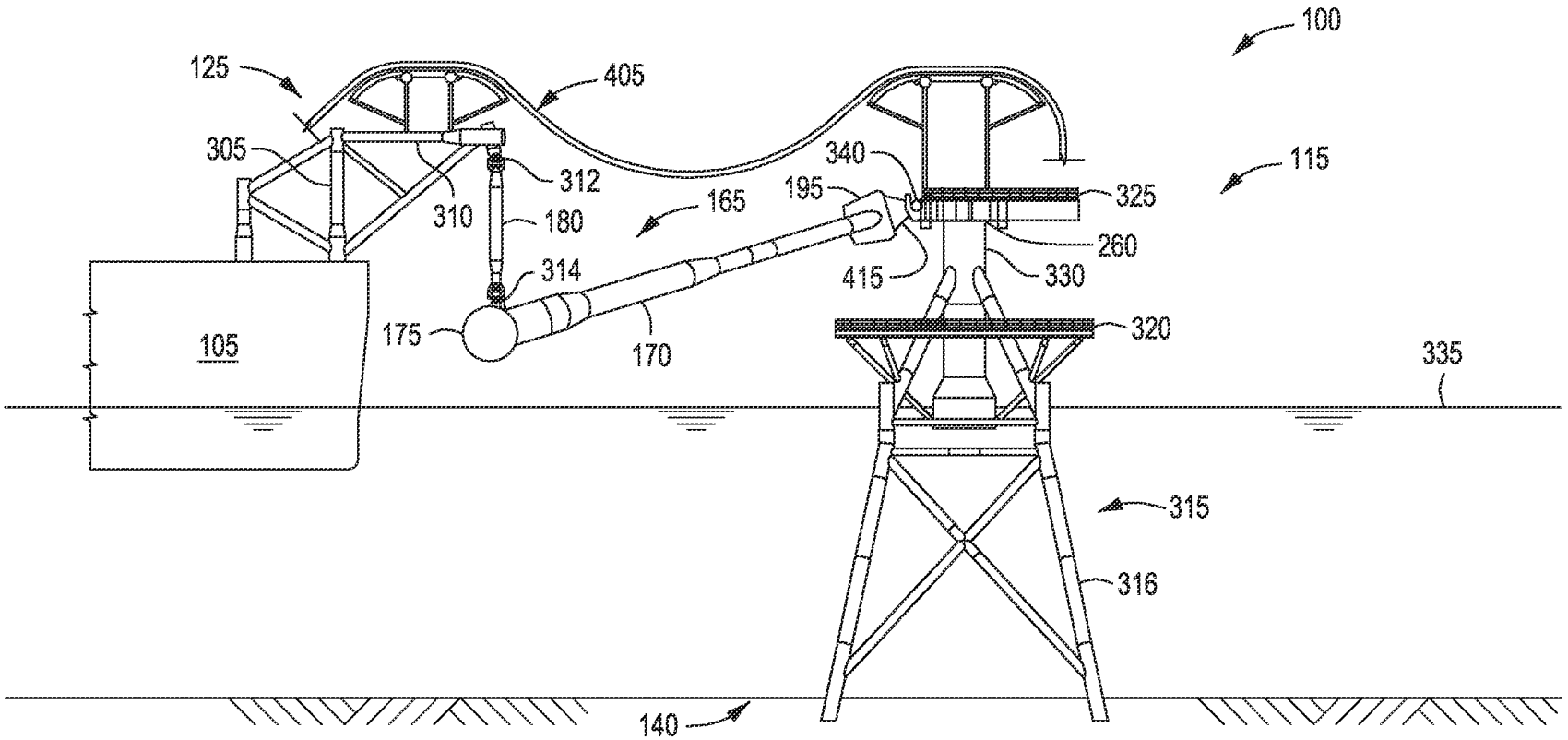
FIG. 4 depicts a schematic of the YMS connected to the elevated mooring support structure depicted in FIG. 3 that further includes a fluid transfer system disposed therebetween.
Figure 4A:
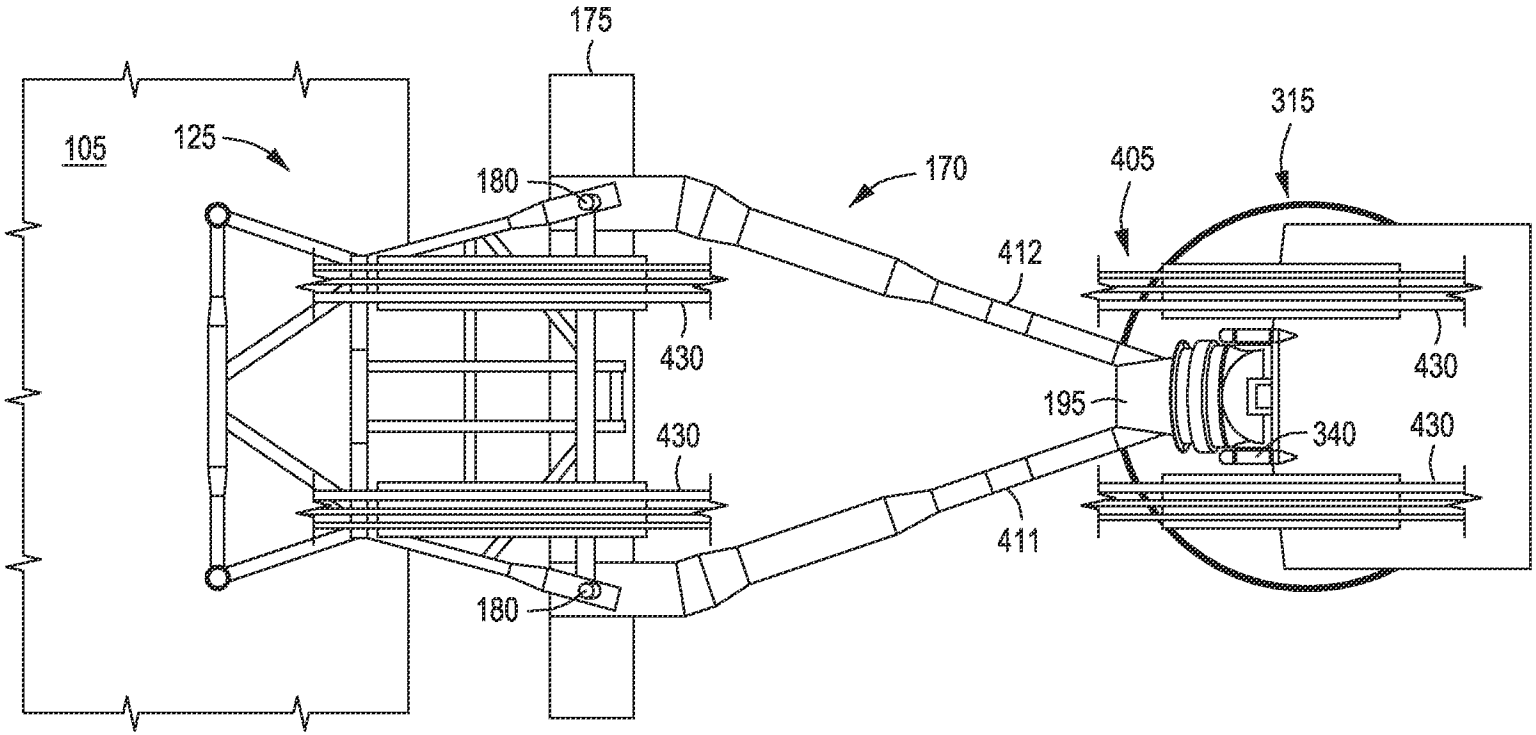
FIG. 4A depicts a schematic top section view of the fluid transfer system depicted in FIG. 4.

FIG. 4 depicts a schematic of the YMS 165 connected to the elevated mooring support structure 115 depicted in FIG. 3 with a transfer system 405 disposed therebetween, according to one or more embodiments. FIG. 4A depicts a schematic top section view of the transfer system 405 depicted in FIG. 4, according to one or more embodiments. Referring to FIGS. 4 and 4A, the transfer system 405 can include one or more elongated conduits 430. The elongated conduits 430 can be or can include any one or more of a variety of different types of elongated conduits. In some embodiments, the elongated conduits 430 can be or can include one or more hoses for transmitting one or more fluids, one or more electric cables for transmitting power and/or signals, one or more data transmission cables, e.g., fiber optic cables, one or more mooring or anchoring lines, e.g., chain, cable, or rope, or any combination thereof. In some embodiments, the one or more elongated conduits 430 can be a series of rigid pipes such as loading arms or can be an articulated pipe system with cryogenic swivels. The one or more elongated conduits 430 can transfer fluids. The fluids can include fluids such as oil or gas, including liquid natural gas. The fluids can include water, instrument or service air, nitrogen, lubrication fluid, hydraulic oil, hardening oil, machining oils and emulsions, honing oil, thermal oil (heat transfer oil), transformer oil, various types of solvents, maintenance oil, or any fluid. In some embodiments, if the elongated conduits 430 transfer water, the water can be used as potable water, or any other suitable use. The one or more elongated conduits 430 can be made from any suitable material. For example, the one or more elongated conduits 430 can be made from a synthetic fiber such as polyester or nylon filament, rubber, synthetic rubbers, a helix of steel alloy wire, a helix polyvinyl chloride plastic, or other suitable materials. The one or more elongated conduits 430 can be utilized for transfer of fluids to and from storage locations, among other uses.

Figure 5:
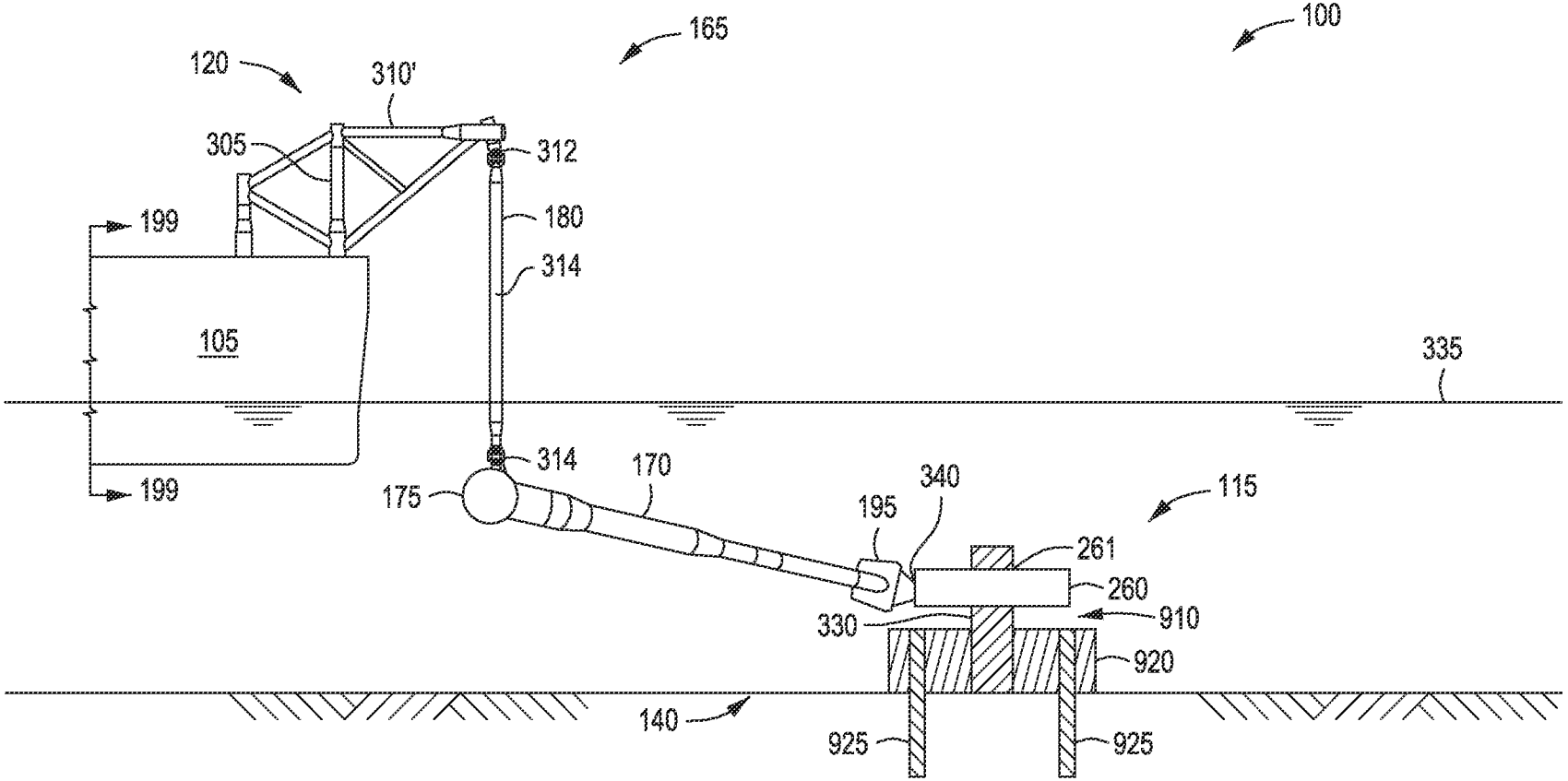
FIG. 5 depicts a schematic side elevation section view of the system and vessel depicted in FIG. 1, showing another embodiment in which the YMS is connected to a submerged mooring support structure.

FIG. 5 depicts a schematic side elevation section view 199 of the mooring system 100 and vessel 105 shown in FIG. 1, showing another embodiment in which the YMS 165 is connected to a submerged mooring support structure 910, according to one or more embodiments. The submerged mooring support structure 910 can be fixed to the seabed 140 but can also be suspended or floating, anchored, or moored. The submerged mooring support structure 910 can include a base structure 920 that can be fixedly connected to the seabed 140 via one or more pilings 925 (two are shown). The turntable 260 can be disposed or otherwise secured to a king post or column 330. The turntable 260 can include the bearing 261 to limit the vessel 105 rotation about the bearing 261 to less than plus or minus one-hundred and eighty degrees about the subsea base assembly 410.

Figure 6:
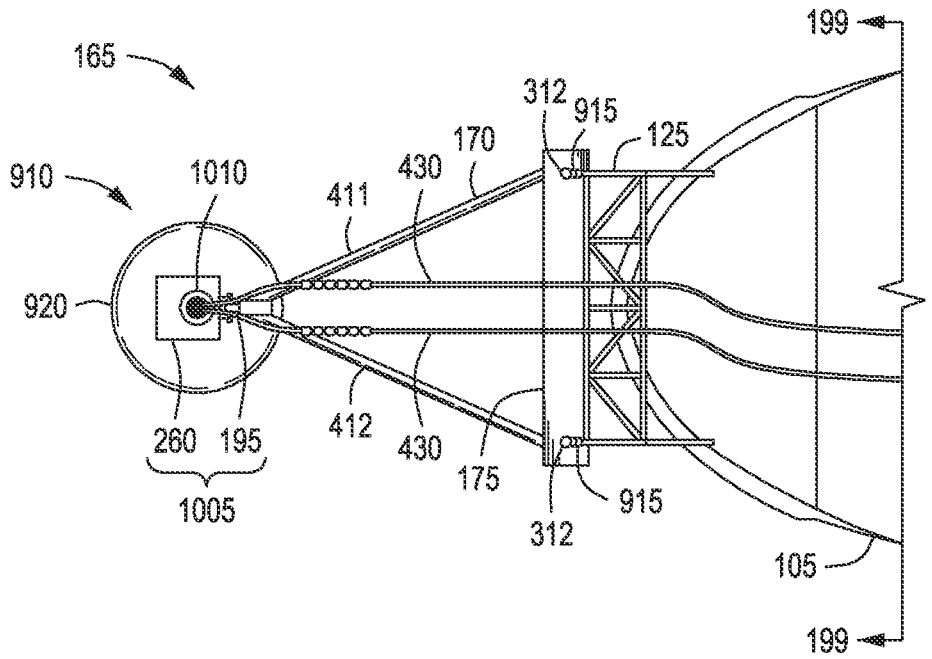
FIG. 6 depicts a plan schematic of a YMS connected to a subsea mooring support structure, according to one or more embodiments described.
Figure 7:
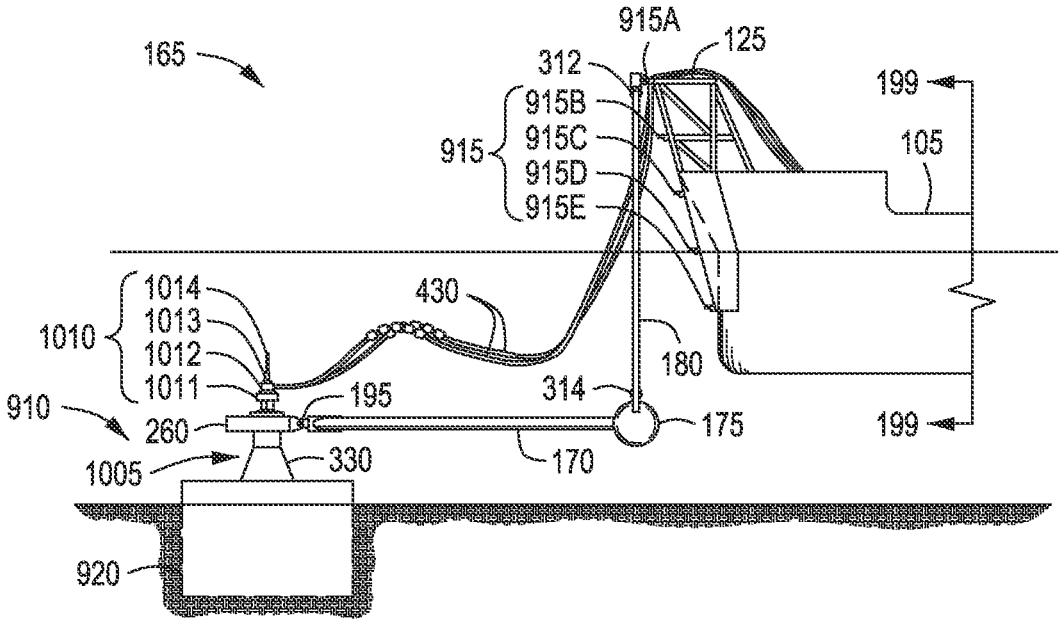
FIG. 7 depicts an elevation view of the YMS connected to the subsea mooring support structure depicted in FIG. 6 according to one embodiment.
Figure 8:
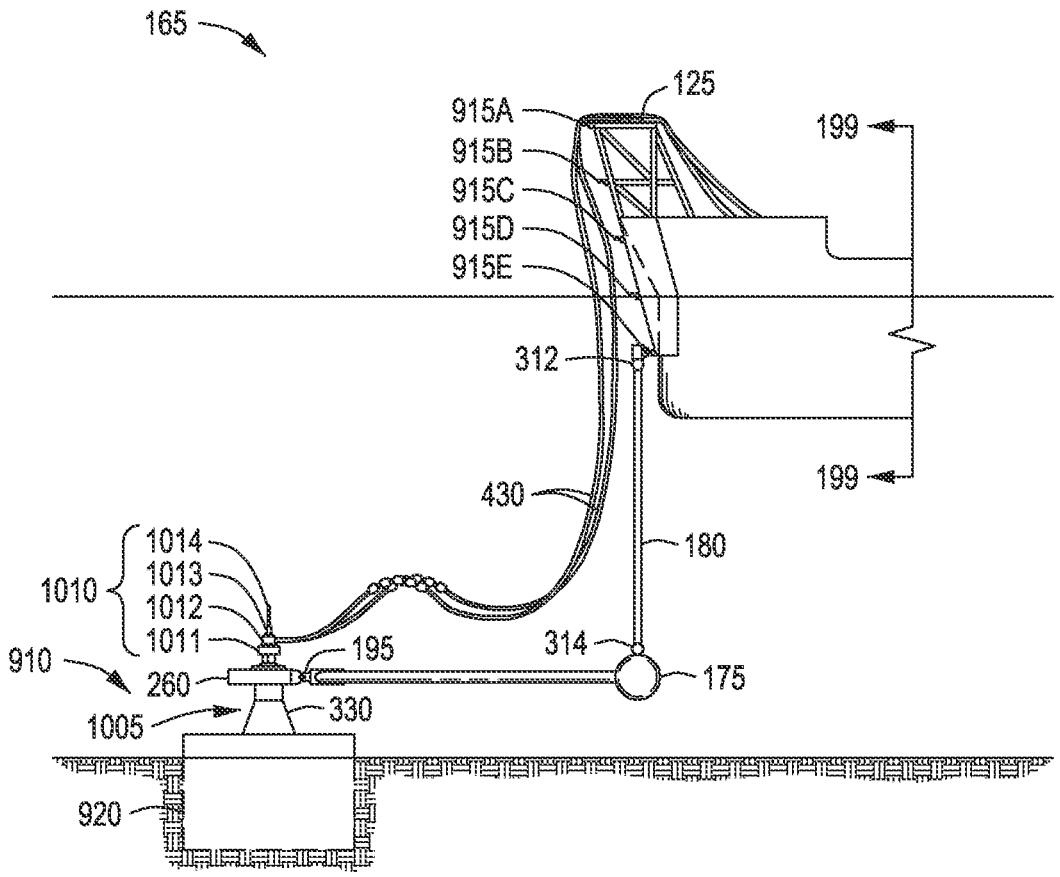
FIG. 8 depicts another elevation view of the YMS connected to the subsea base assembly depicted in FIG. 6, according to another embodiment.

FIG. 6 depicts a plan schematic of the YMS 165 connected to a submerged mooring support structure 910, according to one or more embodiments. FIG. 7 depicts an elevation view of the YMS 165 connected to the submerged mooring support structure 910 depicted in FIG. 6, according to one or more embodiments. FIG. 8 depicts another elevation view schematic of the YMS 165 connected to the submerged mooring support structure 910 depicted in FIG. 6, according to one or more embodiments. The vessel 105 can be moored in shallow-water to the YMS 165 which can be adjustable and disconnectable and can accommodate different water depths. FIG. 7 depicts the YMS 165 installed and in use at a first water depth, for example 20 meters, and FIG. 8 depicts the YMS 165 installed and in use at a second, deeper water depth, for example 40 meters.

The YMS 165 can be connected or affixed to the seabed by the submerged mooring support structure 910, and to the vessel 105 by the vessel support structure 125. To moor the vessel 105, the YMS 165 can be connected to the vessel support structure 125 at one of several connection points 915.

The submerged mooring support structure 910 can include the king post 330 that can support the YMS 165. The bottom of the king post 330 can be extended to the mudline and can connect into an anchor system 920. The anchor system 920 can be removable and can include one or more suction piles or a gravity-based structure. As such, the anchor system 920 can allow the YMS 165 to be relocated to different locations. In some embodiments, the yoke head 195 can include a two-axis universal joint. The turntable 260 and yoke head 195 can form an assembly 1005 and can allow the vessel 105 to pitch and yaw relative to the submerged mooring support structure 910. In some embodiments, a roll bearing can be incorporated into the yoke head 195 and the turntable 260, the yoke head 195 with the roll bearing and the two-axis universal joint can form an assembly 1005 that can allow the vessel 105 to pitch, yaw, and roll relative to the submerged mooring support structure 910.

In some embodiments, a swivel stack 1010 can be disposed atop the assembly 1005. The swivel stack 1010 can include a fluid transfer swivel 1111 and may also include as appropriate a water injection swivel 1112, a utility swivel 1113, and an electrical and/or optical slip ring assembly 1114. The one or more elongated conduits 430 can be connected between the swivel stack 1010 and the vessel 105 to transfer fluids, power, and/or control signals. In other embodiments, rigid or semi-rigid piping, with or without fluid transfer swivels and/or articulated joints, can be provided.

In some embodiments, the vessel support structure 125 can include one or more connection points 915 to which the one or more extension arms 180 can be connected. In FIG. 7, the one or more extension arms 180 are connected to an upper connection point 915A, and in FIG. 8, the one or more extension arms 180 are connected to a lower connection point 915E. As can be seen by this difference between FIGS. 11 and 12, by appropriately selecting connection points 915, the same extension YMS 165 and submerged mooring support structure 910 designs can be used for widely varying water depths.

Figure 9:
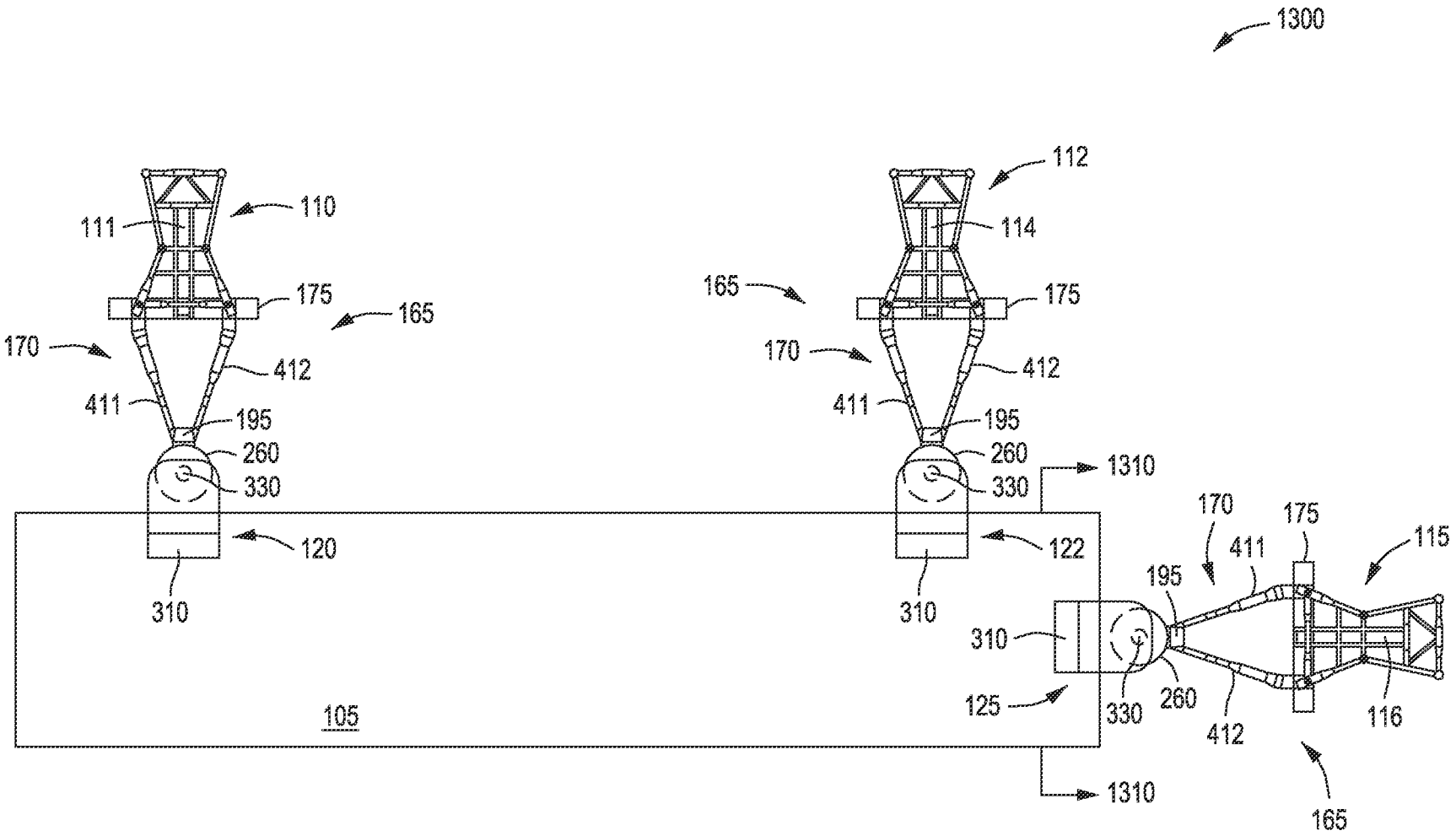
FIG. 9 depicts a schematic of another illustrative system securing a vessel to a plurality of mooring support structures by a plurality of YMS, according to one or more embodiments described.

FIG. 9 depicts a schematic of another illustrative system 1300 securing a vessel 105 to a plurality of mooring support structures 110, 112, and 115, according to one or more embodiments. The vessel support structure 125 from section view 1310 can be or can include the generally horizontal section 310 cantilevered over the edge of the vessel 105. The generally horizontal section 310 can be configured to or adapted to support the king post 330 and turntable 260 connected to the YMS 165 and mooring support structure 115.

Figure 10:
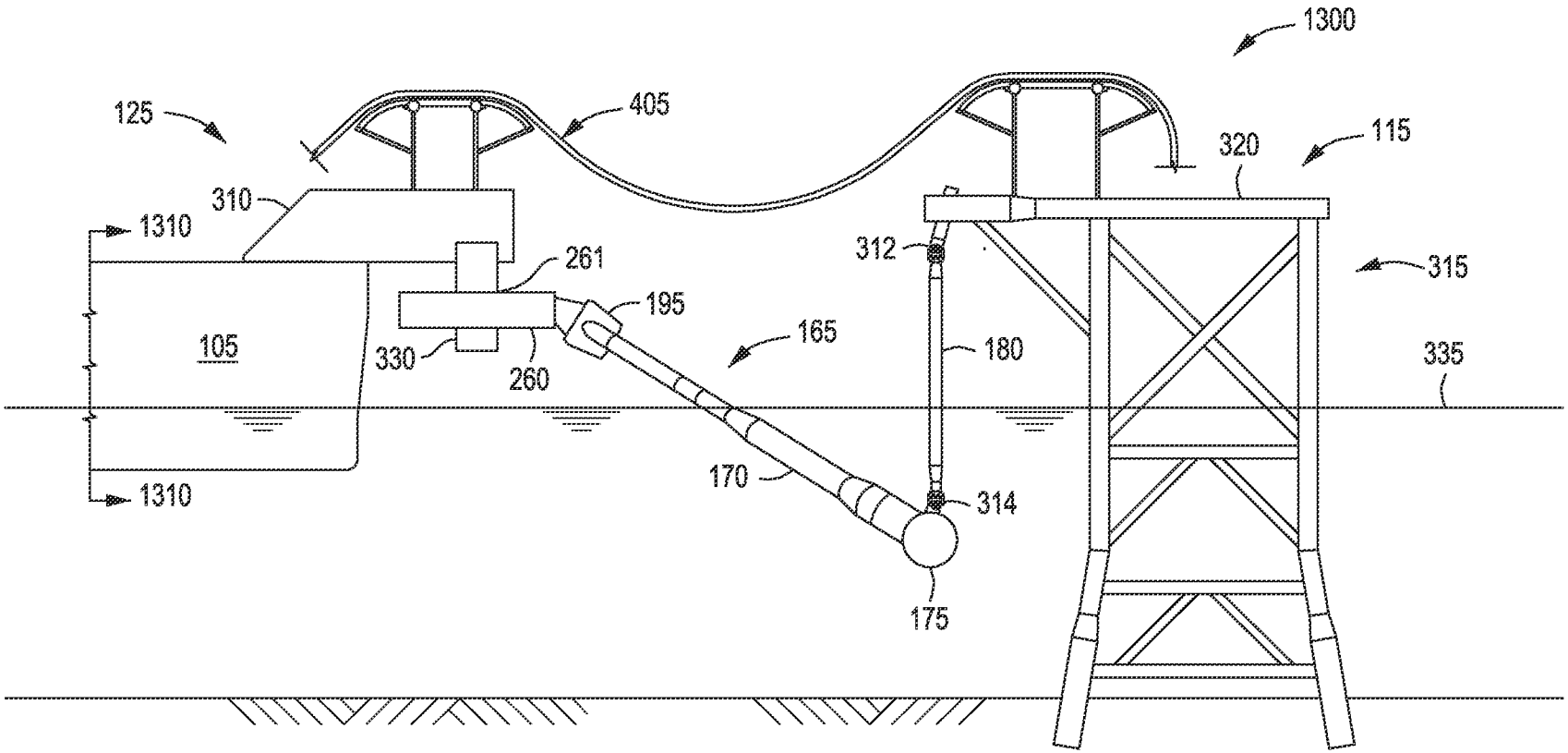
FIG. 10 depicts a schematic of a vessel moored to a mooring support structure where one or more extension arms of the YMS are suspended from the mooring support structure, according to one or more embodiments described.

FIG. 10 depicts a schematic of the vessel 105 moored to the mooring support structure 115 where the one or more extension arms 180 are suspended from the mooring support structure 115, according to one or more embodiments. As shown, the king post 330 can be connected to and/or suspended from the generally horizontal section 310, the turntable 260 can be disposed around the king post 330 such that the turntable 260 can rotate about the king post 330, and the YMS 165 can be connected to the turntable 260 such that the vessel 105 can rotate about the king post 330 without impacting the YMS 165. In some embodiments, the yoke 170, ballast tank 175, and one or more extension arms 180 can be partially or fully submerged below the water line 335. In other embodiments, the yoke 170, ballast tank 175, and one or more extension arms 180 can be suspended above the water line 335.

Figure 11:
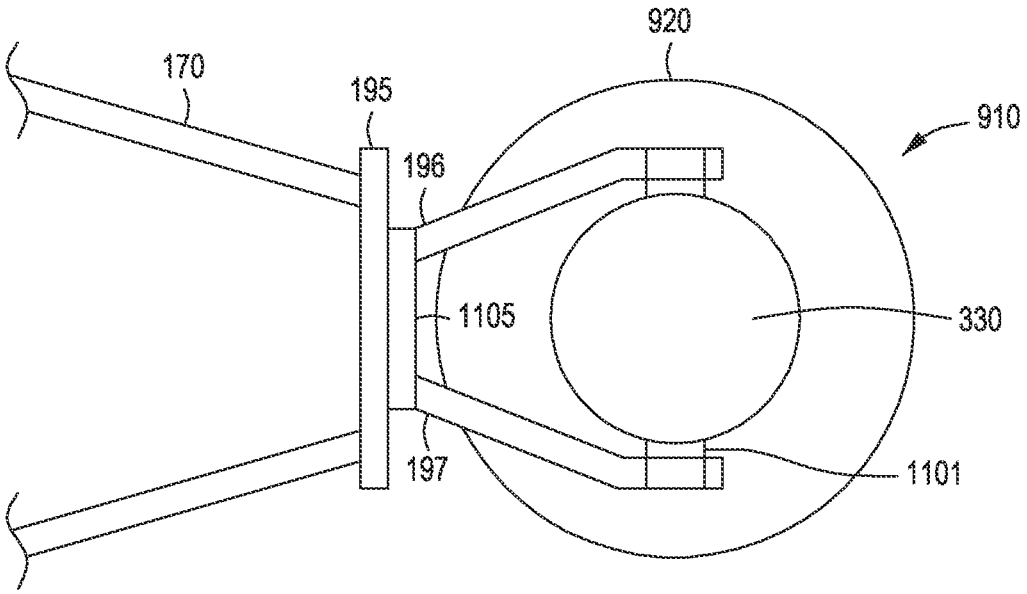
FIG. 11 depicts a schematic of an illustrative yoke head coupled to a pitch bearing of a submerged mooring support structure, according to one or more embodiments described.
Figure 12:
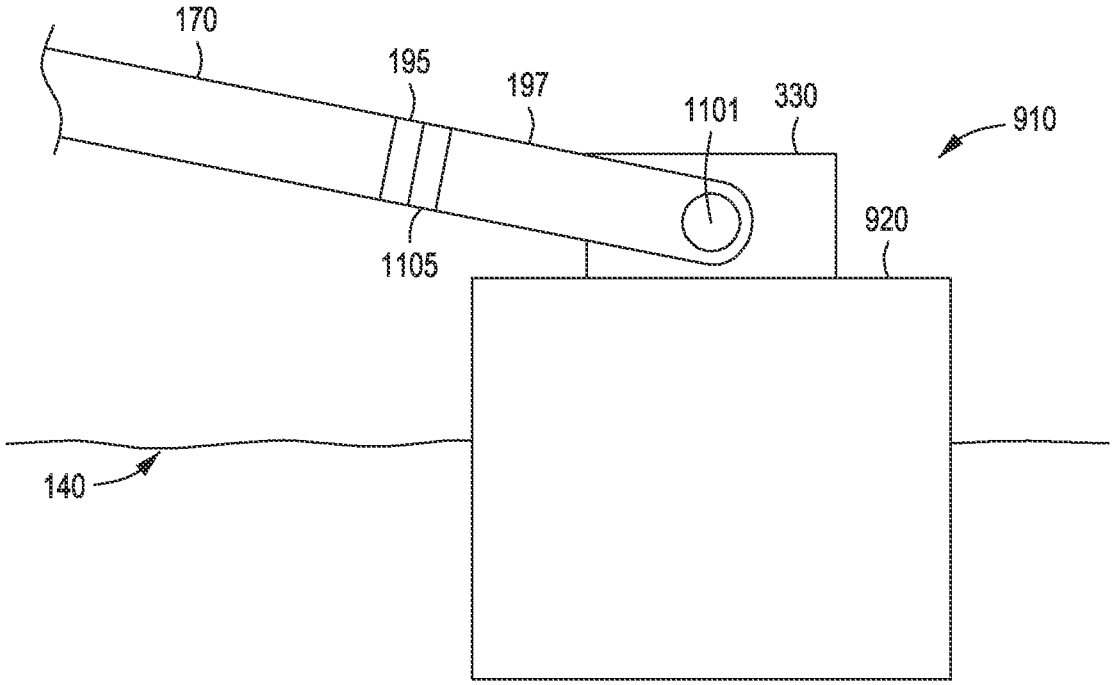
FIG. 12 depicts a schematic side elevation section view of the illustrative yoke head coupled to the pitch bearing of the mooring support structure shown in FIG. 11.

FIG. 11 depicts a schematic of an illustrative yoke head 195 coupled to a pitch bearing 1101 of a submerged mooring support structure 910, according to one or more embodiments. FIG. 12 depicts a schematic side elevation section view of the yoke head 195 coupled to the pitch bearing 1101 of the submerged mooring support structure 910 shown in FIG. 11. The submerged mooring support structure 910 can be fixed to the seabed 140. For example, the submerged mooring support structure 910 can include a base structure 920 that can be fixedly connected to the seabed 140 via one or more pilings as described above with reference to FIG. 5.

In some embodiments, the yoke head 195 can include a pair of arms 196, 197 that can be coupled to the yoke head 195 at a first end and can be coupled to the pitch bearing 1101 at a second end. As shown, the pitch bearing 1101 can be a rod disposed through a king post 330 or a pair of rods coupled, e.g., welded or otherwise connected, to an outer surface of the king post 330. The pitch bearing 1101 can be configured to allow the yoke 170 to pivot about a horizontal axis relative to the mooring support structure 910. As shown, the king post 330 can be coupled to or integral with the base structure 920. The pitch bearing 1101 can be any pitch bearing capable of allowing the yoke 170 to pivot about a horizontal axis relative to the submerged mooring support structure 910. In some embodiments, the yoke head 195 can include a roll bearing 1105. The roll bearing 1105 can be configured to allow the yoke 170 to rotate relative to the mooring support structure 910 along a longitudinal axis of the yoke head 195. As shown, the yoke head 195 includes the roll bearing 1105 and the pair of arms is connected to the roll bearing 1105.

Figure 13:
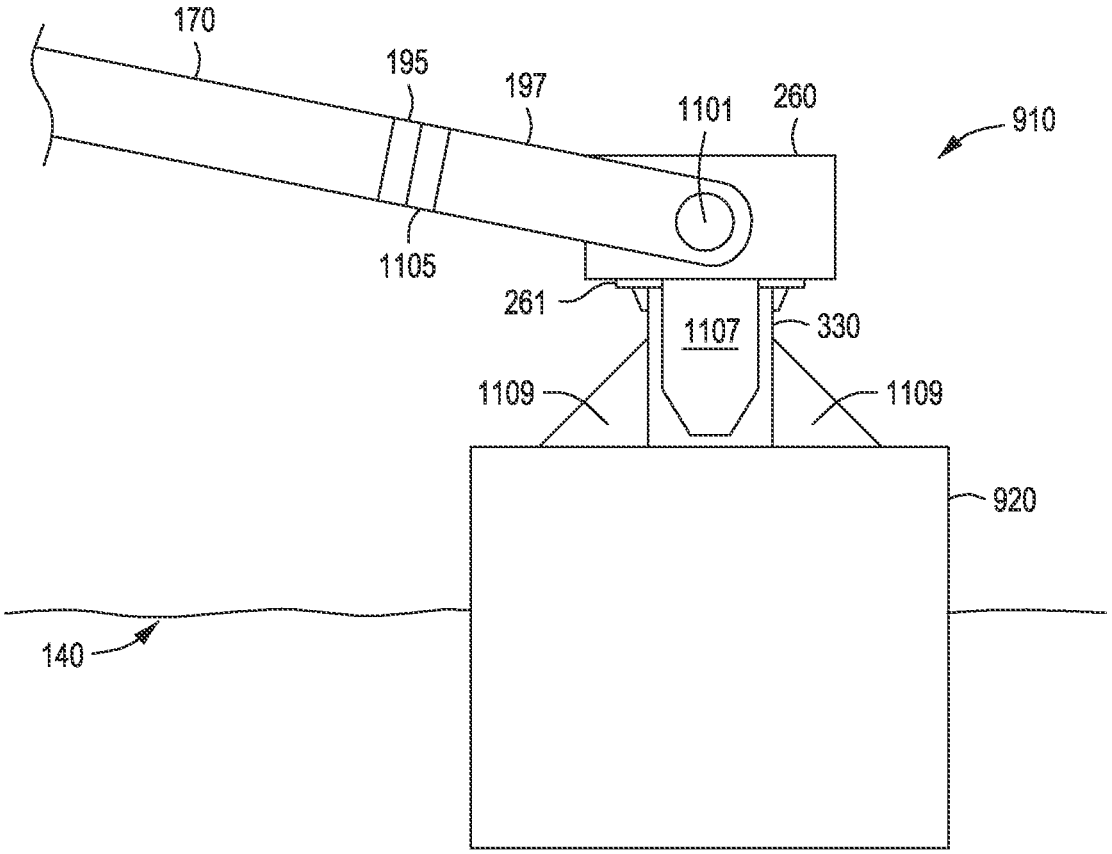
FIG. 13 depicts a schematic side elevation section view of a yoke head coupled to a pitch bearing, the pitch bearing connected to a turntable having a stab pin disposed within a king post connected to a submerged mooring support structure, according to one or more embodiments described.

FIG. 13 depicts a schematic side elevation section view of a yoke head 195 coupled to a pitch bearing 1101, the pitch bearing 1101 connected to a turntable 260 having a stab pin 1107 disposed within a king post 330 connected to a submerged mooring support structure 910, according to one or more embodiments. The submerged mooring support structure 910 can include a base structure 920 that can be fixedly connected to the seabed 140 via one or more pilings as described above with reference to FIG. 5. The turntable 260 can include one or more bearings 261. In some embodiments, the bearing 261 can be a roller bearing, a slide bearing, or any other suitable bearing. In some embodiments the stab pin 1107 can freely rest within the king post 330. In other embodiments, the stab pin 1107 can be secured within the king post 330. In some embodiments one or more gussets 1109 (two are shown) can be used to provide additional reinforcement to the king post 330 relative to the base structure 920. As shown, the yoke head 195 can include the roll bearing 1105 to allow the yoke 170 to rotate relative to the mooring support structure 910.

Figure 14:
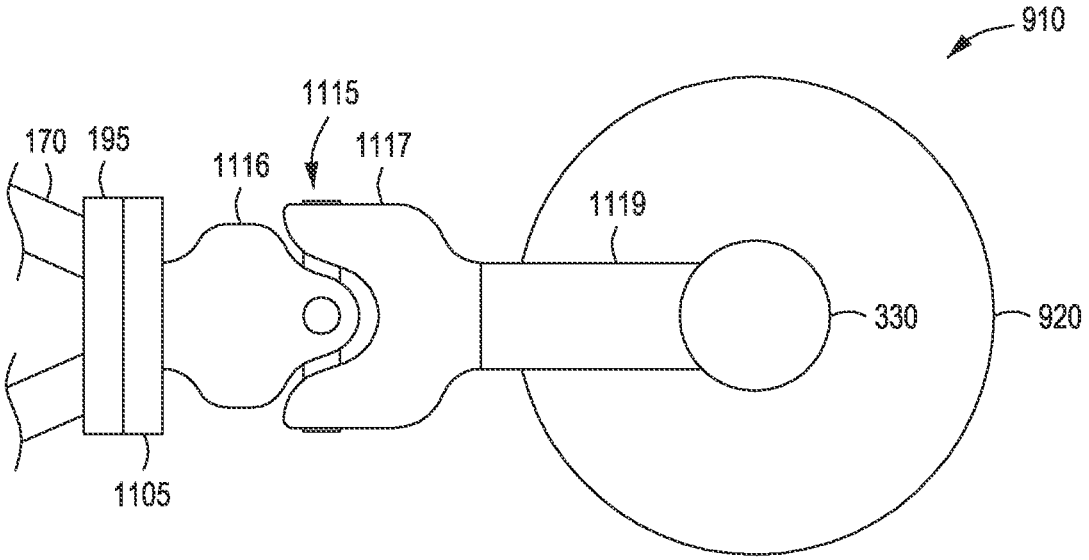
FIG. 14 depicts a schematic of an illustrative yoke head coupled to a submerged mooring support structure by a universal joint, according to one or more embodiments described.
Figure 15:
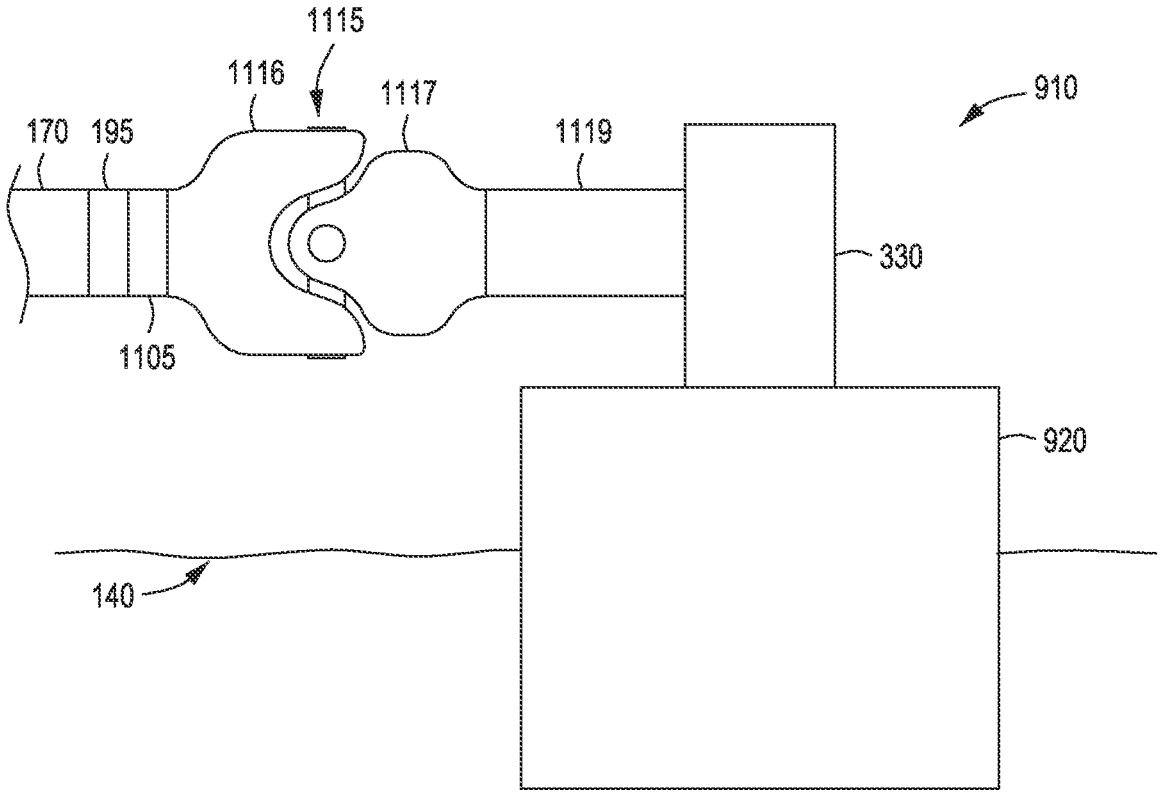
FIG. 15 depicts a schematic side elevation view of the yoke head coupled to the mooring support structure shown in FIG. 14.
Figure 16:
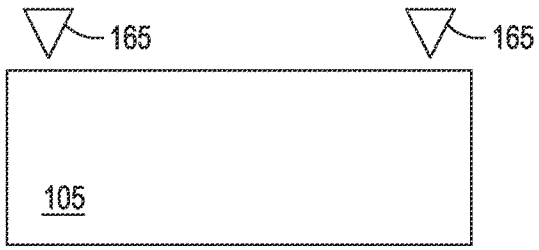
FIGS. 16-21 each depict a schematic of an illustrative YMS arrangement about the vessel for securing the vessel in a stabilized mooring position, according to one or more embodiments described.
Figure 17:
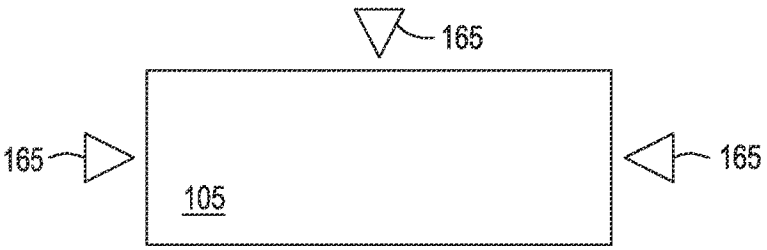
Figure 18:
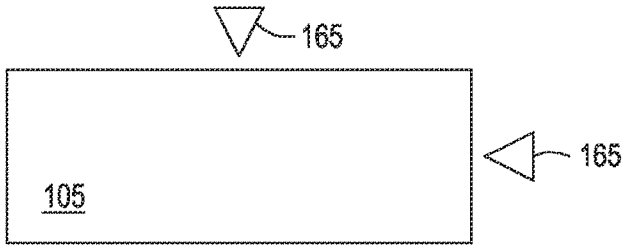
Figure 19:
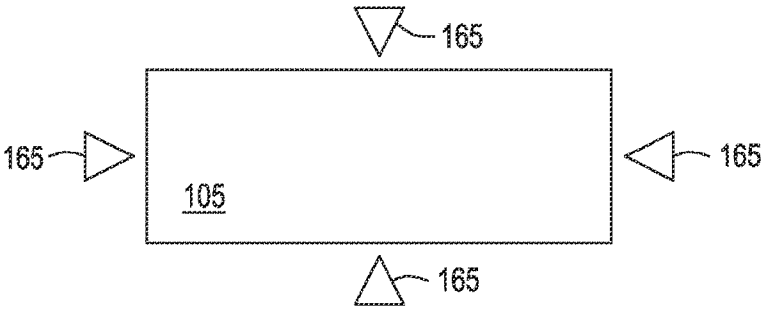
Figure 20:
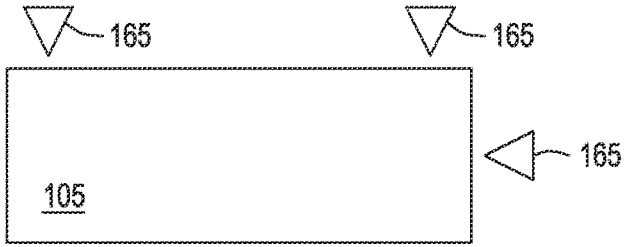
Figure 21:
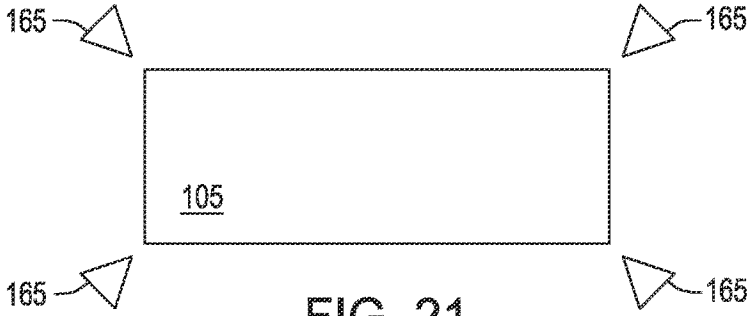

FIG. 14 depicts a schematic of an illustrative yoke head 195 coupled to a submerged mooring support structure 910 by a universal joint 1115, according to one or more embodiments. FIG. 15 depicts a schematic side elevation view of the yoke head 195 coupled to the submerged mooring support structure 910 shown in FIG. 14. As shown, a first portion 1116 of the universal joint 1115 can be connected to the yoke head 195 and a second portion 1117 of the universal joint 1115 can be connected to the king post 330. The universal joint 1115 can permit the yoke 170 to pitch and yaw relative to the submerged mooring support structure 910. In some embodiments, the second portion 1117 of the universal joint 1115 can be connected to the king post 330 via an extension arm 1119. In some embodiments, the yoke head 195 can include a roll bearing 1105 and the roll bearing and the universal joint 1115 can allow the vessel to roll, pitch, and yaw relative to the submerged mooring support structure 910. The roll bearing 1105 can be configured to allow the yoke 170 to rotate relative to the mooring support structure 910 along a longitudinal axis of the yoke head 195. In other embodiments, the roll bearing 1105 can be integrated with the extension arm 1119 rather than the yoke head 195.

It should be understood that in some embodiments, the submerged mooring support structures 910 shown in FIGS. 11-15 can be fixed to the seabed 140 but can extend above a surface of the water such that the connection between the yoke head 195 and the pitch bearing 1101 or the universal joint 1115 can be above the surface of the water. For example, rather than having the submerged mooring support structures 910, the mooring support structures can be a raised framed structure 315 as described above with reference to FIG. 3.

FIGS. 16-21 each depict a schematic of an illustrative YMS 165 arrangement about the vessel 105 for securing the vessel in a stabilized mooring position, according to one or more embodiments. Together, FIGS. 15-20 provide several, non-limiting embodiments of various YMS 165 arrangements about the vessel 105 for securing the vessel 105 in a stabilized mooring position. Various other YMS 165 arrangements for securing the vessel 105 in a stabilized mooring position can be utilized without departing from the scope of the embodiments provided herein.

It should be understood, in some embodiments, one or more YMSs 165 can be combined with one or more different mooring anchor locations, not shown, such as dock cleats. For example, in some situations a first mooring footprint on one side of the vessel 105 may be less than 50 meters and one or more YMSs 165 may be used to provide this limited mooring footprint, while a second mooring footprint on another side of the vessel 105 may be unlimited. In this embodiment, chains or ropes can be connected between the vessel 105 and one or more dock cleats, one or more loading buoys, one or more anchored mooring locations, and the like, at distances greater than 50 meters. In other embodiments, such as during storm events, chains or ropes can be connected at various locations about the vessel 105 between the vessel 105 and one or more dock cleats, one or more loading buoys, one or more anchored mooring locations, and the like, at distances greater than 50 meters and then subsequently removed after the storm event.

Figure 22:
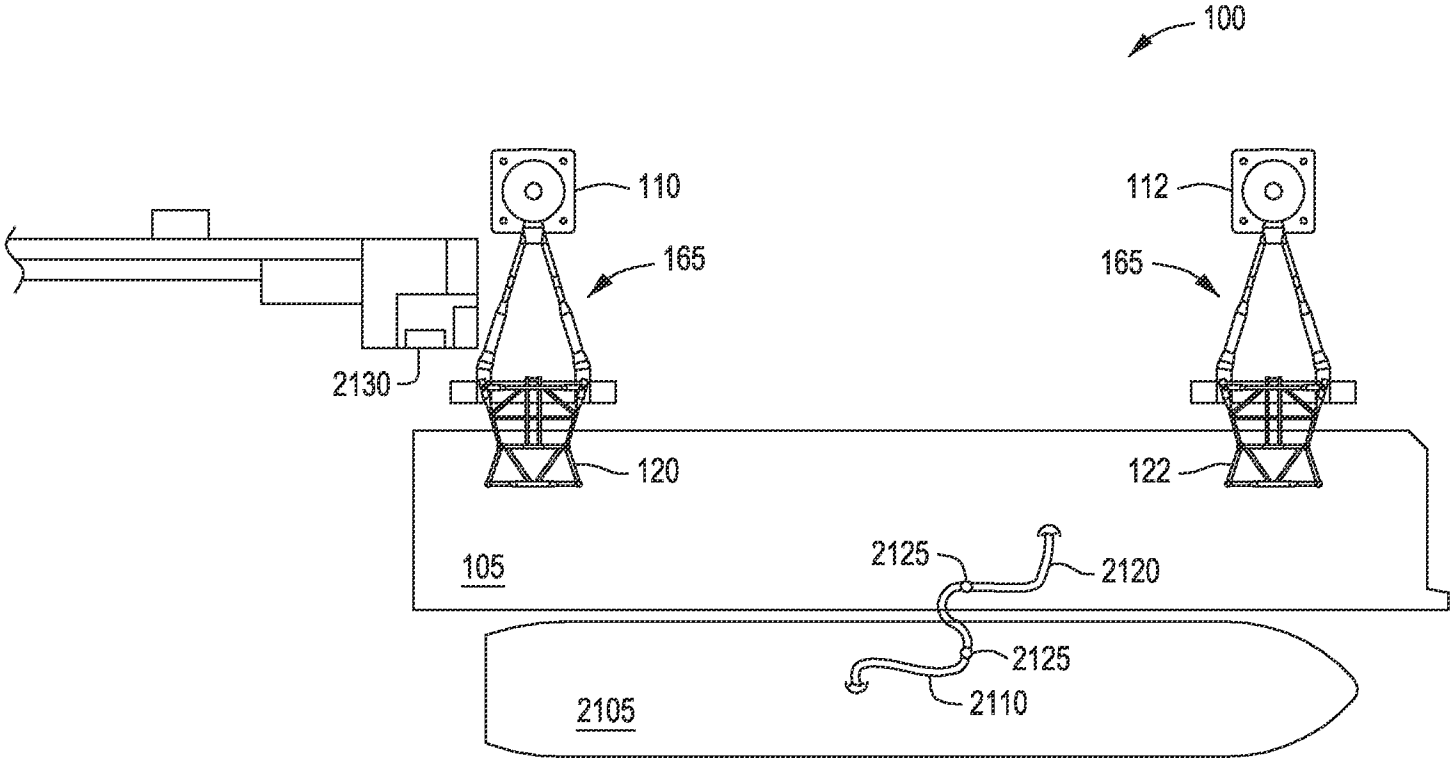
FIG. 22 depicts a schematic of a vessel in a stabilized mooring position during operations with a fluid transportation vessel, according to one or more embodiments described.

FIG. 22 depicts a schematic of the mooring system 100 and vessel 105 with the vessel 105 in a stabilized mooring position during operations with a fluid transportation vessel 2105, according to one or more embodiments described. The fluid transportation vessel 2105 can be any vessel that can transport fluid over water from one location to another location. For example, the fluid transportation vessel 2105 can be a liquid natural gas storage vessel, a production vessel, a liquid transporting barge, or any vessel that can transport fluid over water. The liquid transportation vessel 2105 can transfer fluid to and from the vessel 105 via conduits 2110, 2120 in fluid communications with each other via one or more connections 2125 (two are shown). One or more shore-based facilities 2130 can control and command operations between the vessels 105 and 2105. The shore-based facilities 2130 can be in fluid communications with the vessel 105 for transferring fluid between the vessel 105 and the shore-based facilities 2130. Fluid from the vessel 105 can be processed, transferred to other locations, or otherwise utilized by the shore-based facilities 2130.

Figure 23:
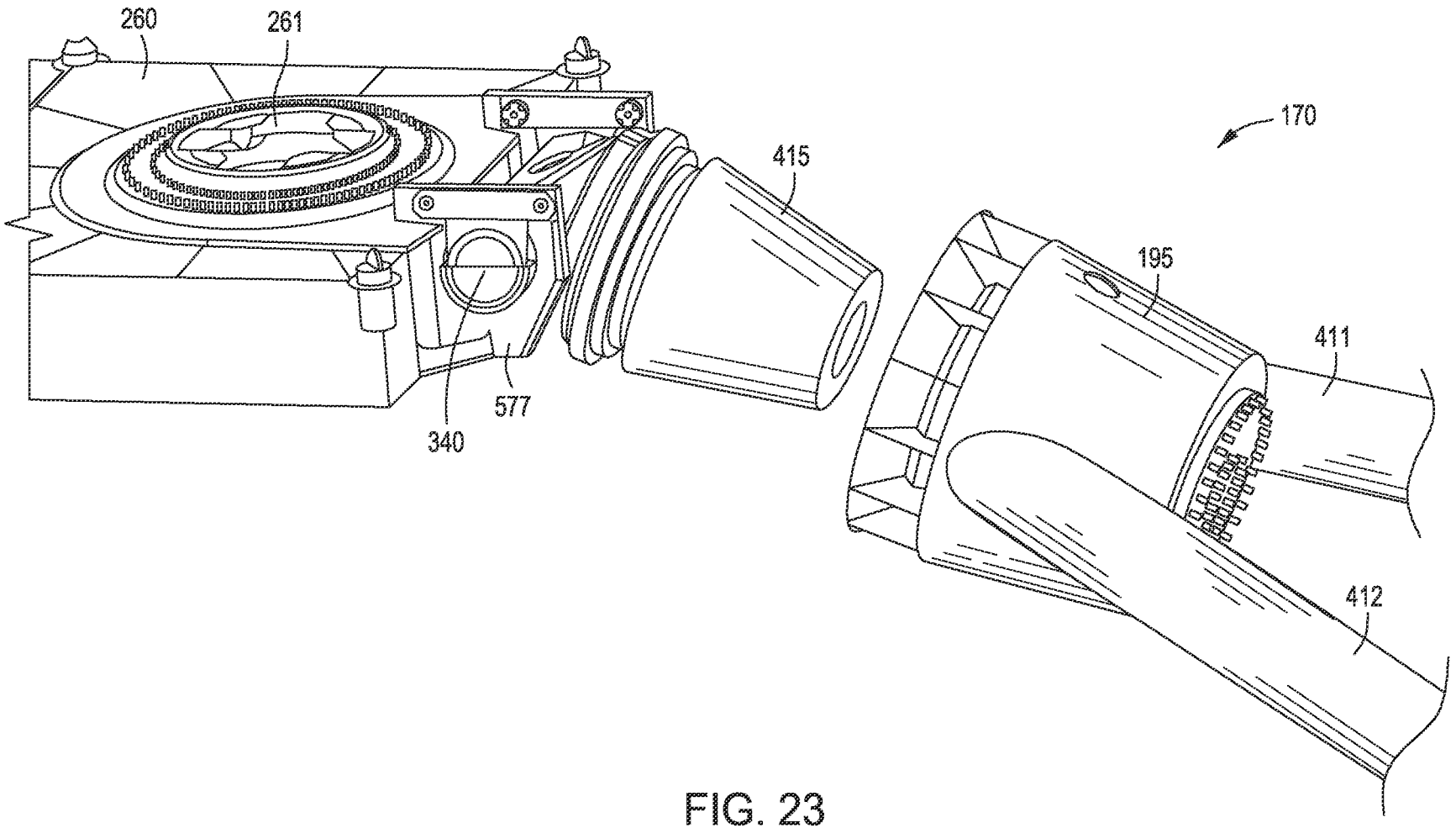
FIG. 23 depicts an enlarged perspective view of an illustrative combination yoke head with a yoke head connector, according to one or more embodiments described.

FIG. 23 depicts an enlarged perspective view of an illustrative combination of a yoke head 195 with a yoke head connector 415, according to one or more embodiments. With reference to FIG. 4 and FIG. 23, in some embodiments, the connection between the yoke head 195 and the mooring support structure 115 can be disconnectable. In one embodiment, the mooring support structure 115 can include the yoke head connector 415 connected to the turntable 260 via bearing 340. The yoke head connector 415 can be a conical or frustoconical body and the yoke head 195 can include a body having a correspondingly shaped inner surface configured or adapted to receive the yoke head connector 415 located on or near a distal end of the yoke 170. A suitable disconnectable yoke head assembly can include the yoke head assembly disclosed in U.S. Pat. No. 9,650,110.

Figure 24:
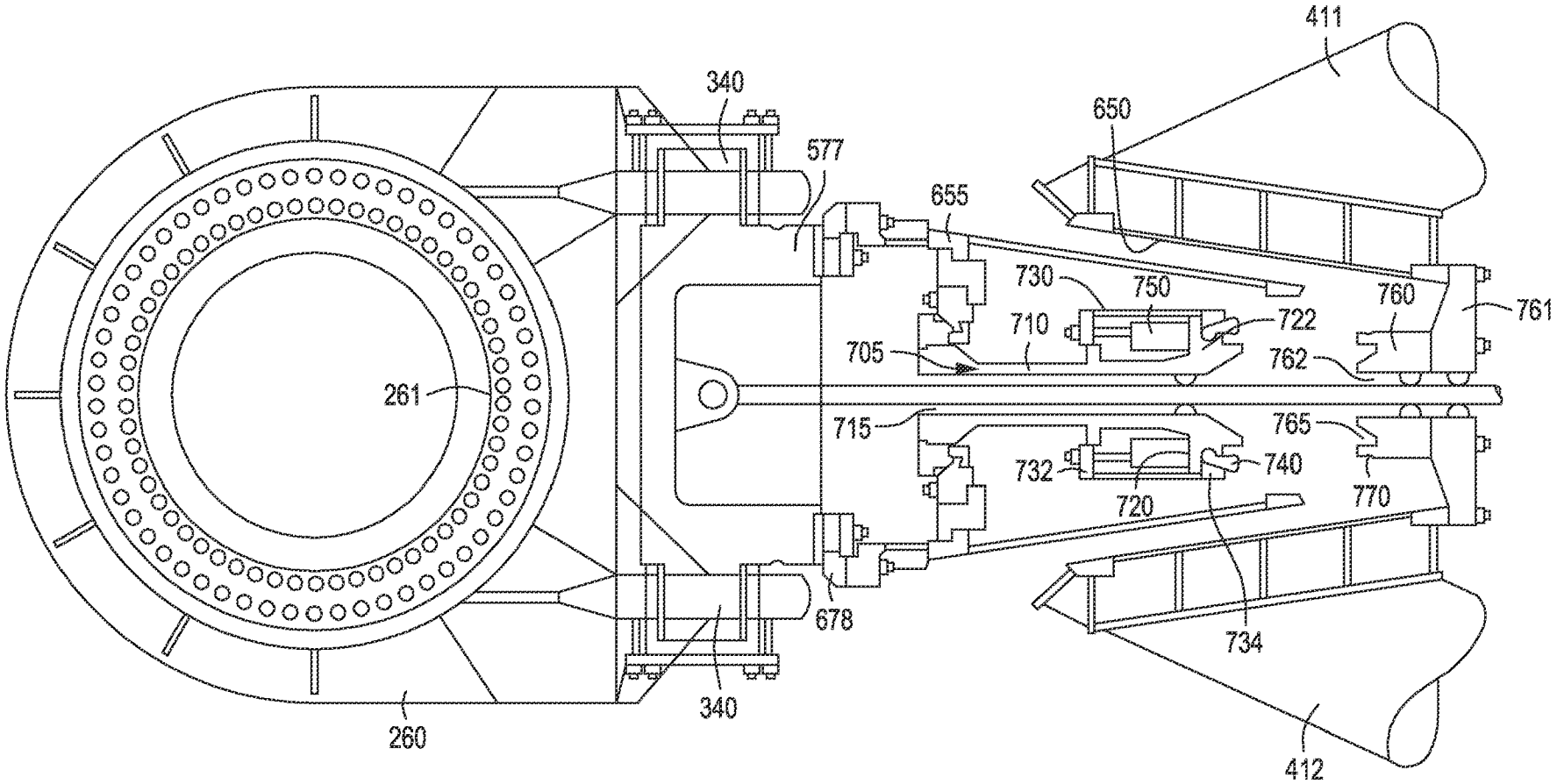
FIG. 24 depicts a partial cross section view of the yoke head and the yoke head connector depicted in FIG. 23 prior to connection, according to one or more embodiments.

FIG. 24 depicts a partial cross section view of the yoke head 195 and the yoke head connector 415 depicted in FIG. 23 prior to connection, according to one or more embodiments. The yoke head connector 415 can be arranged and designed to cooperate with the yoke head 195. Both the yoke head 195 and the yoke head connector 415 can have conical or frusto-conical shaped surfaces: an inner surface 650 of the yoke head 195 (female) and an outer surface 655 of the yoke head connector 415 (male). These complementary surfaces can provide a sliding surface to facilitate and guide the connection between the yoke head 195 and the yoke head connector 415. It should be understood that the yoke head 195 can be the male component and the yoke head connector 415 can be the female component.

Referring to FIGS. 23 and 24, the yoke head connector 415 can be mounted to the turntable 260 using one or more joints or connectors 340 that allow for pivotal movement relative to the turntable 260. The yoke head connector 415 can be trunnion mounted to the turntable 260. The trunnion mounted connector 340 can extend outwardly from a trunnion housing 577. One or more roll bearings 678 can be used to allow the yoke head connector 415 to rotate along a longitudinal axis thereof relative to the turntable 260. One or more cylinders, not shown, can be connected to the trunnion housing 577 and to the turntable 260. The cylinders can be used to help move the yoke head connector 415 to facilitate the connection with the yoke head 195.

Figure 25:
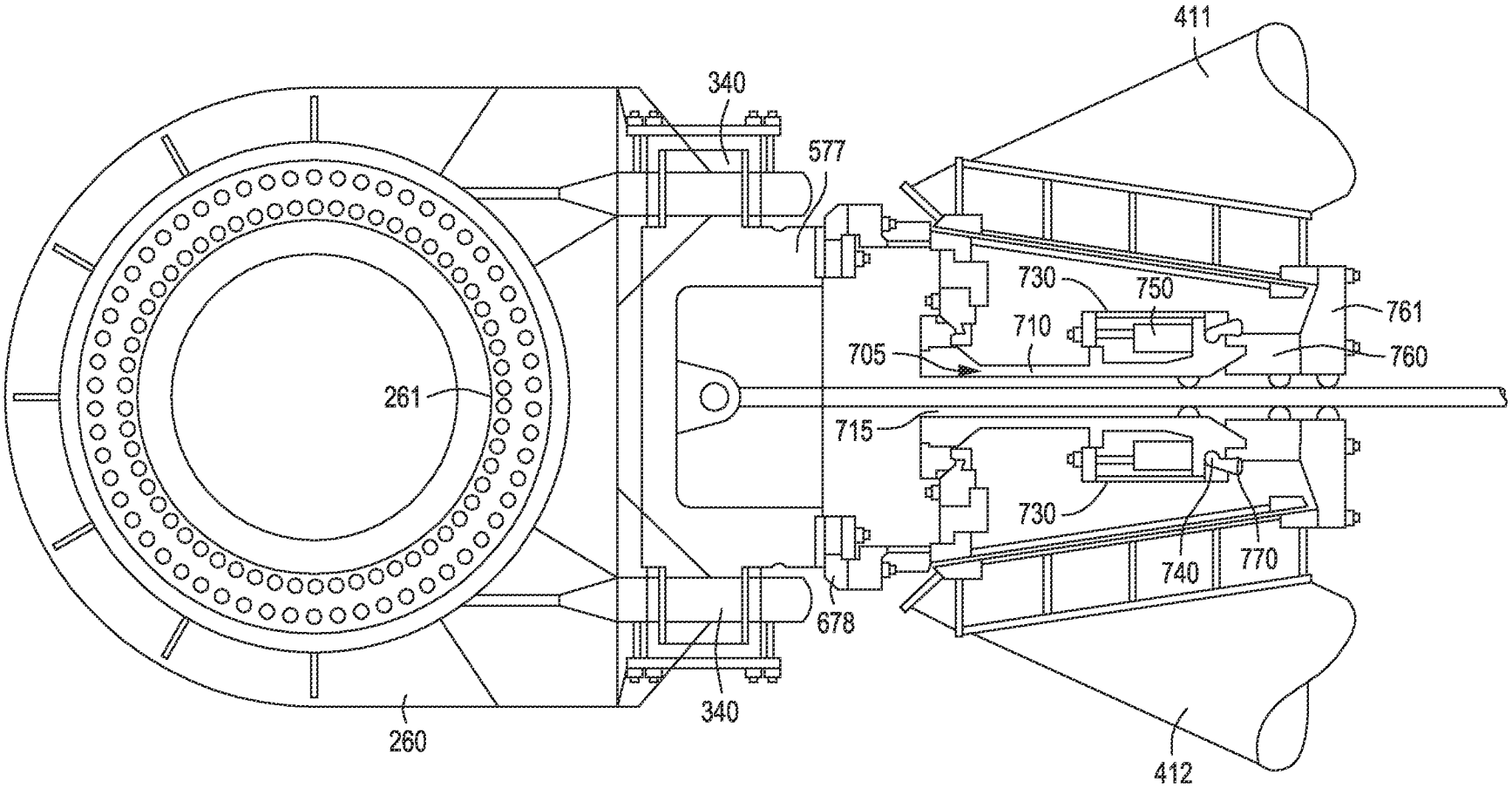
FIG. 25 depicts an enlarged schematic view of the working internals of the yoke head and the yoke head connector depicted in FIG. 23 and FIG. 24, according to one or more embodiments.

FIG. 25 depicts an enlarged schematic view of the working internals of the yoke head 195 and the yoke head connector 415 depicted in FIG. 23 and FIG. 24, according to one or more embodiments. Referring to FIGS. 24 and 25, a hydraulic connection assembly 705 can be mounted within the yoke head connector 415. The hydraulic connection assembly 705 can include a housing 710 having a bore 715 formed therethrough. The housing 710 can have an outwardly facing shoulder 720 and an extension or projection 722 formed thereon. One or more spaced apart fingers or collet segments 740 can be disposed about the housing 710 between the shoulder 720 and the projection 722. The outwardly facing shoulder 720 can be adjacent to and in contact with the fingers 740.

A movable sleeve 730 can be disposed about the housing 710. The movable sleeve 730 can have an inwardly directed flange 732 at one end and a band 734 at an opposite end. The band 734 can be adjacent to and configured to contact the one or more fingers 740. Linear movement of the sleeve 730 in a first direction (toward the vessel 105) allows the fingers 740 to rotate or pivot to a closed or locked position and linear movement of the sleeve 730 in an opposite, second direction (toward the mooring support structure 115) allows the fingers 740 to rotate or pivot about the outer surface of the housing 710 to an open or unlocked position.

One or more hydraulic cylinders or actuators 750 can be used to move the sleeve 730 about the outer surface of the housing 710, allowing the fingers 740 to rotate or pivot open and close. The one or more actuators 750 can be positioned between and connected to the inwardly directed flange 732 of the movable sleeve 730 and the outwardly facing shoulder 720 of the stationary housing 710. The actuator(s) 750 can be hydraulic or pneumatic cylinders. When more than one actuator 750 is used, the actuators 750 can be controlled by a singular control to provide simultaneous operation and movement of the sleeve 730. The actuators 750 can be actuated from the mooring support structure 115 (FIG. 4) by accumulators and telemetry-controlled valves. Accumulators and telemetry-controlled valves are well known to those skilled in the art.

Still referring to FIGS. 24 and 25, the yoke head 195 can include a mating hub 760 for receiving and connecting to the hydraulic connection assembly 705 of the yoke head connector 415. An annular adapter or member 761 can be disposed on the yoke head 195 and can be used to mount the mating hub 760. The mating hub 760 also can be an annular member having a bore 762 formed therethrough. The mating hub 760 can include a recessed section or receptacle 765 that can be sized and shaped to receive the projection 722 on the assembly housing 710. The mating hub 760 can also include a notched or profiled outer surface 770. The profiled outer surface 770 can be configured to engage and hold a similarly contoured profile that can be disposed on the fingers 740 such that when the fingers 740 rotate or pivot to their locked or closed position, the shaped profiles located on the fingers 740 and the outer surface 770 of the mating hub 760 matingly engage one other, as depicted in FIG. 25.

Figure 26:
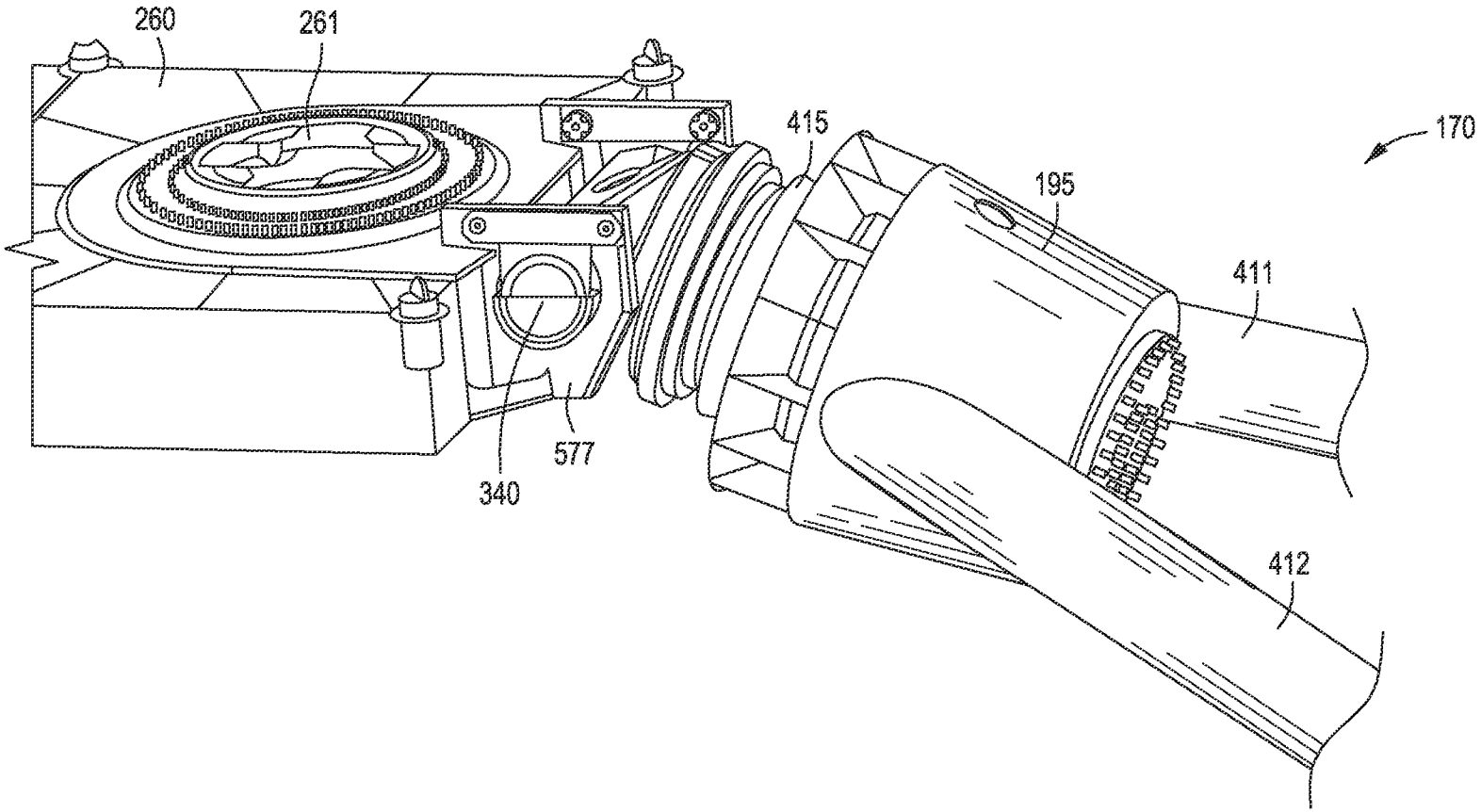
FIG. 26 depicts a partial cross section view of a connected configuration of the yoke head and the yoke head connector depicted in FIG. 23, according to one or more embodiments.

FIG. 26 depicts a partial cross section view of a connected configuration of the yoke head 195 and the yoke head connector 415 depicted in FIG. 23, according to one or more embodiments. As depicted, the actuators 750 have moved the moveable sleeve 730 in the first direction toward the vessel 105, pushing the fingers 740 to rotate or pivot inwardly (toward the outer surface of the housing 710), such that the fingers 740 on the connector 270 engage the recessed profile 770 of the mating hub 760. In this closed position, the fingers 740 are generally parallel to the bore 715 of the housing 710 and overlap the profiled outer surface 770 on the mating hub 760, forming a lock and key engagement therebetween. Also, in this closed position, the projection 722 on the housing 710 can be located within the receptacle 765 of the mating hub 760. As such, the yoke head connector 415 can be fully engaged with the yoke head 195 and the vessel 105 can be securely moored to the mooring support structure 115. While engaged, the yoke head 195 cannot move or rotate independent of the yoke head connector 415. Although not shown, a secondary mechanical lock in line with the actuators 750 can be used to keep the connection without the need of hydraulic pressure. A suitable secondary mechanical lock can be an interference sleeve lock, such as for example, the Bear-Loc™ locking device, manufactured by Wellman Dynamics Machining and Assembly Inc. of York, Pa.

In one or more embodiments, a process for securing the vessel in stabilized mooring position can include: motivating a floating vessel toward two or more mooring support structures; orienting two or more YMSs between the vessel and the mooring support structure for connection; connecting a first YMS between a first vessel support structure and a first mooring support structure; connecting a second YMS between a second vessel support structure and a second mooring support structure; and optionally disconnecting at least one YMS from at least one vessel support structure or at least one mooring support structure.

The present disclosure further relates to any one or more of the following paragraphs:

1. A system for securing a floating vessel in a stabilized mooring position, comprising: two or more vessel support structures, each mounted on the floating vessel; two or more mooring support structures, each fixed in place; a first turntable disposed on a first vessel support structure or a first mooring support structure; a second turntable disposed on a second vessel support structure or a second mooring support structure; at least one extension arm suspended from each vessel support structure or each mooring support structure; a ballast tank connected to each of the at least one extension arms; and a yoke extending from and connected to each ballast tank at a first end thereof, each yoke comprising a yoke head disposed on a second end thereof, wherein: at least one turntable is configured to have a rotational travel about a mooring support structure or a vessel support structure that is limited to less than plus or minus one-hundred and eighty degrees, at least one yoke head is connected to the at least one turntable, and at least one ballast tank is configured to provide a restoring force between at least one vessel support structure and at least one mooring support structure.

2. The system of paragraph 1, further comprising at least one yoke head connector connected to the at least one turntable, and wherein each yoke head is engaged with the yoke head connector.

3. The system of paragraph 1 or 2, wherein at least one mooring support structure is fixed to a seabed or a coastal defense structure.

4. The system of any of paragraphs 1 to 3, wherein a mooring anchor location is associated with each mooring support structure and each mooring anchor location is within about 100 meters or less of a side of the vessel.

5. The system of any of paragraphs 1 to 4, wherein at least one mooring support structure comprises a subsea mooring base assembly.

6. The system of any of paragraphs 1 to 5, wherein at least a portion of at least one ballast tank, at least one yoke, or at least one extension arm is at least partially submerged.

7. The system of any of paragraphs 1 to 6, wherein at least one yoke head comprises a mating hub having a recess and a notched profile disposed on an outer surface thereof, the hub being an annular member having a bore formed therethrough.

8. The system of any of paragraphs 1 to 7, wherein the rotational travel of the at least one turntable is limited to less than plus or minus forty-five degrees.

9. The system of any of paragraphs 1 to 8, wherein at least one mooring support structure comprises a raised framed structure.

10. The system of any of paragraphs 1 to 9, wherein at least one vessel support structure comprises a generally horizontal section cantilevered over an edge of the vessel and supporting a king post and the first turntable.

11. The system of any of paragraphs 1 to 10, wherein the at least one extension arm is a rigid body or a flexible body.

12. A process for securing a floating vessel in a stabilized mooring position, comprising: connecting a first yoke head, disposed on a first end of a first yoke, to a first turntable; or connecting one or more first extension arms to a first mooring support structure or a first vessel support structure, wherein: a second end of the first yoke is connected to and extends from a first ballast tank, the first ballast tank is connected to the one or more first extension arms, the first vessel support structure is disposed on the floating vessel, the first mooring support structure is fixed in place, and the first ballast tank is configured to provide a restoring force between the first mooring support structure and the first vessel support structure; and connecting a second yoke head, disposed on a first end of a second yoke, to a second turntable; or connecting one or more second extension arms to a second mooring support structure or a second vessel support structure, wherein: a second end of the second yoke is connected to and extends from a second ballast tank, the second ballast tank is connected to the one or more second extension arms, the second vessel support structure is disposed on the floating vessel, the second mooring support structure is fixed in place, and the second ballast tank is configured to provide a restoring force between the second mooring support structure and the second vessel support structure, wherein: the first and second turntables are disposed on each of either of the mooring support structures or the vessel support structures, and at least one turntable is configured to have a rotational travel about a mooring support structure or a vessel support structure that is limited to less than plus or minus one-hundred and eighty degrees.

13. The process of paragraph 12, further comprising: a first yoke head connector connected to the first turntable, wherein connecting the first yoke head comprises connecting the first yoke head to the first yoke head connector; and a second yoke head connector connected to the second turntable, wherein connecting the second yoke head comprises connecting the second yoke head to the second yoke head connector.

14. The process of paragraph 12 or 13, wherein the yoke head comprises a mating hub having a recess and a notched profile disposed on an outer surface thereof, the hub being an annular member having a bore formed therethrough.

15. The process of any of paragraphs 12 to 14, wherein the yoke head connector is hydraulically actuated.

16. The process of any of paragraphs 12 to 15, further comprising: connecting a third yoke head, disposed on a first end of a third yoke, to a third turntable; or connecting one or more third extension arms to the third mooring support structure or the third vessel support structure, wherein: a second end of the third yoke is connected to and extends from a third ballast tank, the third ballast tank is connected to the one or more third extension arms, the third vessel support structure is mounted on the floating vessel, the third mooring support structure is fixed in place, and the third ballast tank is configured to provide a restoring force between the third mooring support structure and the third vessel support structure.

17. The process of any of paragraphs 12 to 16, wherein at least one vessel support structure comprises a generally vertical portion and a cantilevered generally horizontal portion.

18. The process of any of paragraphs 12 to 17, wherein at least one vessel support structure comprises a generally horizontal section cantilevered over the edge of the vessel that supports a king post and the first turntable.

19. The process of any of paragraphs 12 to 18, wherein the rotational travel of at least one turntable is limited to less than plus or minus forty-five degrees.

20. The process of any of paragraphs 12 to 19, wherein at least one mooring support structure is mechanically fixed to the seabed or a coastal defense structure.

21. The process of any of paragraphs 12 to 20, wherein a mooring anchor location is associated with each mooring support structure and each mooring anchor location is within about 100 meters or less of a hull surface of the vessel.

22. A system for securing a floating vessel in a stabilized mooring position, comprising: two or more vessel support structures, each mounted on the floating vessel; two or more mooring support structures, each fixed in place; at least two extension arms suspended from each vessel support structure or each mooring support structure; a ballast tank connected to each of the at least two extension arms; a first turntable disposed on a first mooring support structure or a first vessel support structure; a second turntable disposed on a second mooring support structure or a second vessel support structure; and a yoke extending from and connected to each ballast tank at a first end thereof, each yoke comprising a yoke head disposed on a second end thereof and engaged with each turntable, wherein: each turntable is configured to have a rotational travel about each mooring support structure or about each vessel support structure that is limited to less than plus or minus one-hundred and eighty degrees, each ballast tank is configured to provide a restoring force between each vessel support structure and each mooring support structure, each extension arm is connected to each vessel support structure or each mooring support structure by a U-joint, at least one mooring support structure comprises a raised framed structure and is mechanically fixed to the seabed, and a mooring anchor location is associated with each mooring support structure and each mooring anchor location is within about 100 meters of a hull surface of the vessel.

23. A system for securing a floating vessel in a stabilized mooring position, comprising: two or more vessel support structures, each mounted on the floating vessel; two or more mooring support structures, each fixed in place; a first turntable disposed on a first vessel support structure or a first mooring support structure; a second turntable disposed on a second vessel support structure or a second mooring support structure; at least one extension arm suspended from each vessel support structure or each mooring support structure; a ballast tank connected to each of the at least one extension arms; and a yoke extending from and connected to each ballast tank at a first end thereof, each yoke comprising a yoke head disposed on a second end thereof, wherein: a first yoke head is connected to the first turntable, a second yoke head is connected to the second turntable, and each ballast tank is configured to provide a restoring force between a vessel support structure and a mooring support structure.

24. The system of paragraph 23, wherein a rotational travel of the first turntable about the first mooring support structure or the first vessel support structure and a rotational travel of the second turn table about the second mooring support structure or the second vessel support structure is limited to less than plus or minus one-hundred and eighty degrees.

25. The system of paragraphs 23 or 24, wherein the vessel is located in water having a depth of less than 50 meters.

26. The system of any of paragraphs 23 to 25, wherein the restoring force comprises a stiffness force.

27. The system of any of paragraphs 23 to 26, wherein the restoring force comprises a tension force.

28. The system of any of paragraphs 23 to 27, wherein the restoring force comprises dampening motion.

29. The system of any of paragraphs 23 to 28, further comprising: at least one yoke head connector connected to the at least one turntable, and wherein each yoke head is engaged with the yoke head connector.

30. The system of any of paragraphs 23 to 29, wherein at least one mooring support structure is fixed to a seabed or a coastal defense structure.

31. The system of any of paragraphs 23 to 30, wherein a mooring anchor location is associated with each mooring support structure and each mooring anchor location is within about 100 meters or less of a side of the vessel.

32. The system of any of paragraphs 23 to 31, wherein at least one mooring support structure comprises a subsea mooring base assembly.

33. The system of any of paragraphs 23 to 32, wherein at least a portion of at least one ballast tank, at least one yoke, or at least one extension arm is at least partially submerged.

34. The system of any of paragraphs 23 to 33, wherein at least one yoke head comprises a mating hub having a recess and a notched profile disposed on an outer surface thereof, the hub being an annular member having a bore formed therethrough.

35. The system of any of paragraphs 23 to 34, wherein the rotational travel of the at least one turntable is limited to less than plus or minus forty-five degrees.

36. The system of any of paragraphs 23 to 35, wherein at least one mooring support structure comprises a raised framed structure.

37. The system of any of paragraphs 23 to 36, wherein at least one vessel support structure comprises a generally horizontal section cantilevered over an edge of the vessel and supporting a king post and the first turntable.

38. The system of any of paragraphs 23 to 37, wherein the at least one extension arm is a rigid body or a flexible body.

39. A process for securing a floating vessel in a stabilized mooring position, comprising: connecting a first yoke head, disposed on a first end of a first yoke, to a first turntable; or connecting one or more first extension arms to a first mooring support structure or a first vessel support structure, wherein: a second end of the first yoke is connected to and extends from a first ballast tank, the first ballast tank is connected to the one or more first extension arms, the first vessel support structure is disposed on the floating vessel, the first mooring support structure is fixed in place, and the first ballast tank is configured to provide a restoring force between the first mooring support structure and the first vessel support structure; and connecting a second yoke head, disposed on a first end of a second yoke, to a second turntable; or connecting one or more second extension arms to a second mooring support structure or a second vessel support structure, wherein: a second end of the second yoke is connected to and extends from a second ballast tank, the second ballast tank is connected to the one or more second extension arms, the second vessel support structure is disposed on the floating vessel, the second mooring support structure is fixed in place, and the second ballast tank is configured to provide a restoring force between the second mooring support structure and the second vessel support structure, wherein: the first and second turntables are disposed on each of either of the mooring support structures or the vessel support structures, and wherein a rotational travel of the first turntable about the first mooring support structure or the first vessel support structure and a rotational travel of the second turn table about the second mooring support structure or the second vessel support structure is limited to less than plus or minus one-hundred and eighty degrees.

40. The process of paragraph 39, wherein the vessel is located in water having a depth of less than 50 meters.

41. The process of paragraph 39 or 40, wherein the restoring force comprises a stiffness force.

42. The process of any of paragraphs 39 to 41, wherein the restoring force comprises a tension force.

43. The process of any of paragraphs 39 to 42, wherein the restoring force comprises dampening motion.

44. The process of any of paragraphs 39 to 43, further comprising: at least one yoke head connector connected to the at least one turntable, and wherein each yoke head is engaged with the yoke head connector.

45. The process of any of paragraphs 39 to 44, wherein at least one mooring support structure is fixed to a seabed or a coastal defense structure.

46. The process of any of paragraphs 39 to 45, wherein a mooring anchor location is associated with each mooring support structure and each mooring anchor location is within about 100 meters or less of a side of the vessel.

47. A system for securing a vessel floating on a surface of a body of water in a stabilized position, comprising: a first vessel support structure and a second vessel support structure, each disposed on the vessel, each vessel support structure comprising: one or more extension arms, each having a first end and a second end, wherein the first end of the one or more extension arms is suspended from the vessel support structure; a ballast tank connected to the second end of the one or more extension arms; and a yoke having a first end and a second end, the first end connected to the ballast tank and the second end comprising a yoke head disposed thereon; a first mooring support structure and a second mooring support structure, each fixed in place, and each mooring support structure comprising a pitch bearing, wherein: the yoke head of the first vessel support structure is connected to the pitch bearing of the first mooring support structure, the pitch bearing of the first mooring support structure is configured to allow the yoke of the first vessel support structure to pivot about a horizontal axis relative to the first mooring support structure, the yoke head of the second vessel support structure is connected to the pitch bearing of the second mooring support structure, the pitch bearing of the second mooring support structure is configured to allow the yoke of the second vessel support structure to pivot about a horizontal axis relative to the second mooring support structure, and the system is configured to provide restoring forces between the first and second mooring support structures and the floating vessel in response to external environmental forces acting on the vessel.

48. A system for securing a vessel floating on a surface of a body of water in a stabilized position, comprising: a first vessel support structure and a second vessel support structure, each disposed on the vessel, each vessel support structure comprising: one or more extension arms, each having a first end and a second end, wherein the first end of the one or more extension arms is suspended from the vessel support structure; a weight connected to the second end of the one or more extension arms; and a yoke having a first end and a second end, the first end connected to the weight tank and the second end comprising a yoke head disposed thereon; a first mooring support structure and a second mooring support structure, each fixed in place, and each mooring support structure comprising a pitch bearing, wherein: the yoke head of the first vessel support structure is connected to the pitch bearing of the first mooring support structure, the pitch bearing of the first mooring support structure is configured to allow the yoke of the first vessel support structure to pivot about a horizontal axis relative to the first mooring support structure, the yoke head of the second vessel support structure is connected to the pitch bearing of the second mooring support structure, the pitch bearing of the second mooring support structure is configured to allow the yoke of the second vessel support structure to pivot about a horizontal axis relative to the second mooring support structure, and the system is configured to provide restoring forces between the first and second mooring support structures and the floating vessel in response to external environmental forces acting on the vessel.

49. The system of paragraph 47 or 48, wherein the first mooring support structure and/or the second mooring support structure further comprises a turntable configured to at least partially rotate about a vertical axis of the first mooring support structure and/or a vertical axis of the second mooring support structure, and wherein the first pitch bearing is connected to the turntable of the first mooring support structure and/or the second pitch bearing is connected to the turntable of the second mooring support structure.

50. The system of any of paragraphs 47 to 49, wherein the yoke head of the first vessel support structure and/or the yoke head of the second vessel support structure comprises a roll bearing configured to allow the yoke of the first vessel support structure and/or the yoke of the second vessel support structure to rotate relative to the first mooring support structure and/or the second mooring support structure along a longitudinal axis of the yoke head of the first vessel support structure and/or the yoke head of the second vessel support structure.

51. The system of any of paragraphs 47 to 50, wherein the system is configured to restrict the vessel from rotating relative to a surface of the earth.

52. The system of any of paragraphs 47 to 51, wherein at least one of the first and second mooring support structures is fixed to a seabed.

53. The system of any of paragraphs 47 to 52, wherein at least one of the first and second mooring support structures is fixed to a coastal defense structure.

54. The system of any of paragraphs 47 to 53, wherein the first and second mooring support structures are each located 100 meters or less from a perimeter of the vessel.

55. The system of any of paragraphs 47 to 54, wherein the first and second mooring support structures are each located 60 meters or less from a perimeter of the vessel.

56. The system of any of paragraphs 47 or 49 to 55, wherein the ballast tank of the first vessel support structure is located above the surface of the body of water.

57. The system of any of paragraphs 47 or 49 to 56, wherein the ballast tank of the second vessel support structure is located above the surface of the body of water.

58. The system of any of paragraphs 47 or 49 to 56, wherein the ballast tank of the second vessel support structure is located below the surface of the body of water.

59. The system of any of paragraphs 47 or 49 to 55, wherein the ballast tank of the first vessel support structure is located below the surface of the body of water.

60. The system of any of paragraphs 47, 49 to 55, or 59, wherein the ballast tank of the second vessel support structure is located below the surface of the body of water.

61. The system of any of paragraphs 48 to 55, wherein the weight of the first vessel support structure is located above the surface of the body of water.

62. The system of any of paragraphs 48 to 55 or 61, wherein the weight of the second vessel support structure is located above the surface of the body of water.

63. The system of any of paragraphs 48 to 55 or 61, wherein the weight of the second vessel support structure is located below the surface of the body of water.

64. The system of any of paragraphs 48 to 55, wherein the weight of the first vessel support structure is located below the surface of the body of water.

65. The system of any of paragraphs 48 to 55 or 64, wherein the weight of the second vessel support structure is located below the surface of the body of water.

66. The system of any of paragraphs 47 to 65, wherein the pitch bearing of the first mooring support structure is located above the surface of the body of water.

67. The system of any of paragraphs 47 to 66, wherein the pitch bearing of the second mooring support structure is located above the surface of the body of water.

68. The system of any of paragraphs 47 to 66, wherein the pitch bearing of the second mooring support structure is located below the surface of the body of water.

69. The system of any of paragraphs 47 to 65, wherein the pitch bearing of the first mooring support structure is located below the surface of the body of water.

70. The system of any of paragraphs 47 to 65 or 69, wherein the pitch bearing of the second mooring support structure is located below the surface of the body of water.

71. The system of any of paragraphs 47 to 70, further comprising a transfer system disposed between the first vessel support structure and the first mooring support structure, the transfer system configured to convey a fluid, electrical power, or a combination thereof from the vessel to the first mooring support structure or from the first mooring support structure to the vessel.

72. The system of claim 71, wherein the transfer system comprises one or more hoses configured to transfer one or more fluids from the vessel to the first mooring support structure or from the first mooring support structure to the vessel.

73. A system for securing a vessel floating on a surface of a body of water in a stabilized position, comprising: a first mooring support structure and a second mooring support structure, each fixed in place and comprising: one or more extension arms, each having a first end and a second end, wherein the first end of the one or more extension arms is suspended from the mooring support structure; a ballast tank connected to the second end of the one or more extension arms; and a yoke having a first end and a second end, the first end connected to the ballast tank and the second end comprising a yoke head disposed thereon; a first vessel support structure and a second vessel support structure, each disposed on the vessel, and each vessel support structure comprising a pitch bearing, wherein: the yoke head of the first mooring support structure is connected to the pitch bearing of the first vessel support structure, the pitch bearing of the first vessel support structure is configured to allow the yoke of the first mooring support structure to pivot about a horizontal axis relative to the first vessel support structure, the yoke head of the second mooring support structure is connected to the pitch bearing of the second vessel support structure, the pitch bearing of the second vessel support structure is configured to allow the yoke of the second mooring support structure to pivot about a horizontal axis relative to the second vessel support structure, and the system is configured to provide restoring forces between the first and second mooring support structures and the floating vessel in response to external environmental forces acting on the vessel.

74. A system for securing a vessel floating on a surface of a body of water in a stabilized position, comprising: a first mooring support structure and a second mooring support structure, each fixed in place and comprising: one or more extension arms, each having a first end and a second end, wherein the first end of the one or more extension arms is suspended from the mooring support structure; a weight connected to the second end of the one or more extension arms; and a yoke having a first end and a second end, the first end connected to the weight and the second end comprising a yoke head disposed thereon; a first vessel support structure and a second vessel support structure, each disposed on the vessel, and each vessel support structure comprising a pitch bearing, wherein: the yoke head of the first mooring support structure is connected to the pitch bearing of the first vessel support structure, the pitch bearing of the first vessel support structure is configured to allow the yoke of the first mooring support structure to pivot about a horizontal axis relative to the first vessel support structure, the yoke head of the second mooring support structure is connected to the pitch bearing of the second vessel support structure, the pitch bearing of the second vessel support structure is configured to allow the yoke of the second mooring support structure to pivot about a horizontal axis relative to the second vessel support structure, and the system is configured to provide restoring forces between the first and second mooring support structures and the floating vessel in response to external environmental forces acting on the vessel.

75. The system of paragraph 73 or 74, wherein the first vessel support structure and/or the second vessel support structure further comprises a turntable configured to at least partially rotate about a vertical axis of the first vessel support structure and/or the second vessel support structure, and wherein the first pitch bearing is connected to the turntable of the first vessel support structure and/or the second pitch bearing is connected to the turntable of the second vessel support structure.

76. The system of any of paragraphs 73 to 75, wherein the yoke head of the first mooring support structure and/or the yoke head of the second mooring support structure comprises a roll bearing disposed on the yoke head, the roll bearing configured to allow the yoke of the first mooring support structure and/or the yoke of the second mooring support structure to rotate relative to the first vessel support structure and/or the second vessel support structure along a longitudinal axis of the yoke head of the first mooring support structure and/or the yoke head of the second mooring support structure.

77. The system of any of paragraphs 73 to 76, wherein the system is configured to restrict the vessel from rotating relative to a surface of the earth.

78. The system of any of paragraphs 73 to 77, wherein at least one of the first and second mooring support structures is fixed to a seabed.

79. The system of any of paragraphs 73 to 78, wherein at least one of the first and second mooring support structures is fixed to a coastal defense structure.

80. The system of any of paragraphs 73 to 79, wherein the first and second mooring support structures are each located 100 meters or less from a perimeter of the vessel.

81. The system of any of paragraphs 73 to 80, wherein the first and second mooring support structures are each located 60 meters or less from a perimeter of the vessel.

82. The system of any of paragraphs 73 or 75 to 81, wherein the ballast tank of the first mooring support structure is located above the surface of the body of water.

83. The system of any of paragraphs 73 or 75 to 82, wherein the ballast tank of the second mooring support structure is located above the surface of the body of water.

84. The system of any of paragraphs 73 or 75 to 82, wherein the ballast tank of the second mooring support structure is located below the surface of the body of water.

85. The system of any of paragraphs 73 or 75 to 81, wherein the ballast tank of the first mooring support structure is located below the surface of the body of water.

86. The system of any of paragraphs 73, 75 to 81, or 85, wherein the ballast tank of the second mooring support structure is located below the surface of the body of water.

87. The system of any of paragraphs 74 to 81, wherein the weight of the first mooring support structure is located above the surface of the body of water.

88. The system of any of paragraphs 74 to 81 or 87, wherein the weight of the second mooring support structure is located above the surface of the body of water.

89. The system of any of paragraphs 74 to 81 or 87, wherein the weight of the second mooring support structure is located below the surface of the body of water.

90. The system of any of paragraphs 74 to 81, wherein the weight of the first mooring support structure is located below the surface of the body of water.

91. The system of any of paragraphs 74 to 81 or 90, wherein the weight of the second mooring support structure is located below the surface of the body of water.

92. The system of any of paragraphs 73 to 91, wherein the pitch bearing of the first vessel support structure is located above the surface of the body of water.

93. The system of any of paragraphs 73 to 92, wherein the pitch bearing of the second vessel support structure is located above the surface of the body of water.

94. The system of any of paragraphs 73 to 92, wherein the pitch bearing of the second vessel support structure is located below the surface of the body of water.

95. The system of any of paragraphs 73 to 91, wherein the pitch bearing of the first vessel support structure is located below the surface of the body of water.

96. The system of any of paragraphs 73 to 91 or 95, wherein the pitch bearing of the second vessel support structure is located below the surface of the body of water.

97. The system of any of paragraphs any of paragraphs 73 to 96, further comprising a transfer system disposed between the first vessel support structure and the first mooring support structure, the transfer system configured to convey a fluid, electrical power, water, or a combination thereof from the vessel to the first mooring support structure or from the first mooring support structure to the vessel.

98. The system of paragraph 97, wherein the transfer system comprises one or more hoses configured to transfer one or more fluids from the vessel to the first mooring support structure or from the first mooring support structure to the vessel.

99. A process for securing a vessel floating on a surface of a body of water in a stabilized position, comprising: providing a vessel floating on a surface of a body of water comprising: a first vessel support structure and a second vessel support structure, each disposed on the vessel, and each vessel support structure comprising: one or more extension arms, each having a first end and a second end, wherein the first end of the one or more extension arms is suspended from the vessel support structure; a ballast tank connected to the second end of the one or more extension arms; and a yoke having a first end and a second end, the first end connected to the ballast tank and the second end comprising a yoke head disposed thereon; connecting the yoke head of the first vessel support structure to a first pitch bearing disposed on a first mooring support structure, wherein the first mooring support structure is fixed in place; and connecting the yoke head of the second vessel support structure to a second pitch bearing disposed on a second mooring support structure, wherein the second mooring support structure is fixed in place, wherein: the connection between the yoke head of the first vessel support structure and the first pitch bearing allows the yoke of the first vessel support structure to pivot about a horizontal axis relative to the first mooring support structure, the connection between the yoke head of the second vessel support structure and the second pitch bearing allows the yoke of the second vessel support structure to pivot about a horizontal axis relative to the second mooring support structure, the vessel is maintained in a stabilized position upon connection between the yoke head of the first vessel support structure to the first pitch bearing and connection between the yoke head of the second vessel support structure to the second pitch bearing, and the connection between the yoke head of the first vessel support structure to the first pitch bearing and connection between the yoke head of the second vessel support structure to the second pitch bearing provides a system that provides restoring forces between the first and second mooring support structures and the floating vessel in response to external environmental forces acting on the vessel.

100. A process for securing a vessel floating on a surface of a body of water in a stabilized position, comprising: providing a vessel floating on a surface of a body of water comprising: a first vessel support structure and a second vessel support structure, each disposed on the vessel, and each vessel support structure comprising a pitch bearing disposed thereon; locating the vessel adjacent a first mooring support structure and a second mooring support structure, each mooring support structure fixed in place, and each mooring support structure comprising: one or more extension arms, each having a first end and a second end, wherein the first end of the one or more extension arms is suspended from the mooring support structure; a ballast tank connected to the second end of the one or more extension arms; and a yoke having a first end and a second end, the first end connected to the ballast tank and the second end comprising a yoke head disposed thereon; connecting the yoke head of the first mooring support structure to the pitch bearing of the first vessel support structure; and connecting the yoke head of the second mooring support structure to the pitch bearing of the second vessel support structure, wherein: the connection between the yoke head of the first mooring support structure and the first pitch bearing allows the yoke of the first mooring support structure to pivot about a horizontal axis relative to the first vessel support structure, the connection between the yoke head of the second mooring support structure and the second pitch bearing allows the yoke of the second mooring support structure to pivot about a horizontal axis relative to the second vessel support structure, the vessel is maintained in a stabilized position upon connection between the yoke head of the first mooring support structure to the first pitch bearing and connection between the yoke head of the second mooring support structure to the second pitch bearing, and the connection between the yoke head of the first mooring support structure to the first pitch bearing and connection between the yoke head of the second mooring support structure to the second pitch bearing provides a system that provides restoring forces between the first and second mooring support structures and the floating vessel in response to external environmental forces acting on the vessel.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be, therefore, expressly understood that such modifications and adaptations may be devised without departing from the basic scope thereof, and the scope thereof can be determined by the claims that follow.

What is claimed is:

1. A system for securing a vessel floating on a surface of a body of water in a stabilized position, comprising:

a first vessel support structure and a second vessel support structure, each disposed on the vessel, each vessel support structure comprising:

one or more extension arms, each having a first end and a second end, wherein the first end of the one or more extension arms is suspended from the vessel support structure;

a ballast tank connected to the second end of the one or more extension arms; and a yoke having a first end and a second end, the first end connected to the ballast tank and the second end comprising a yoke head disposed thereon; and a first mooring support structure and a second mooring support structure, each fixed in place, and each mooring support structure comprising a pitch bearing, wherein:

the yoke head of the first vessel support structure is connected to the pitch bearing of the first mooring support structure, the pitch bearing of the first mooring support structure is configured to allow the yoke of the first vessel support structure to pivot about a horizontal axis relative to the first mooring support structure, the yoke head of the second vessel support structure is connected to the pitch bearing of the second mooring support structure, the pitch bearing of the second mooring support structure is configured to allow the yoke of the second vessel support structure to pivot about a horizontal axis relative to the second mooring support structure, and the system is configured to provide restoring forces between the first and second mooring support structures and the floating vessel in response to external environmental forces acting on the vessel.

2. The system of claim 1, wherein the first mooring support structure further comprises a turntable configured to at least partially rotate about a vertical axis of the first mooring support structure, and wherein the pitch bearing of the first mooring support structure is connected to the turntable.

3. The system of claim 1, wherein the yoke head of the first vessel support structure comprises a roll bearing configured to allow the yoke to rotate relative to the first mooring support structure along a longitudinal axis of the yoke head.

4. The system of claim 1, wherein the second mooring support structure further comprises a turntable configured to at least partially rotate about a vertical axis of the second mooring support structure, and wherein the pitch bearing of the second mooring support structure is connected to the turntable.

5. The system of claim 1, wherein the yoke head of the second vessel support structure comprises a roll bearing configured to allow the yoke to rotate relative to the second mooring support structure along a longitudinal axis of the yoke head.

6. The system of claim 1, wherein the system restricts the vessel from rotating relative to a surface of the earth.

7. The system of claim 1, wherein at least one of the first and second mooring support structures is fixed to a seabed.

8. The system of claim 1, wherein at least one of the first and second mooring support structures is fixed to a coastal defense structure.

9. The system of claim 1, wherein the ballast tank of the first vessel support structure is located above the surface of the body of water.

10. The system of claim 1, wherein the ballast tank of the first vessel support structure is located below the surface of the body of water.

11. The system of claim 1, wherein the pitch bearing of the first mooring support structure is located above the surface of the body of water.

12. The system of claim 1, wherein the pitch bearing of the first mooring support structure is located below the surface of the body of water.

13. The system of claim 1, further comprising a transfer system disposed between the first vessel support structure and the first mooring support structure, the transfer system configured to convey a fluid, electrical power, or a combination thereof from the vessel to the first mooring support structure or from the first mooring support structure to the vessel.

14. The system of claim 1, wherein each yoke is formed from one or more tubular members.

15. The system of claim 1, wherein:

the first vessel support structure is located on a port side or a starboard side of the vessel, the second vessel support structure is located on a bow or a stern of the vessel between the port side and the starboard side of the vessel, and the system restricts the vessel from rotating relative to a surface of the earth.

16. The system of claim 1, wherein:

the first vessel support structure is located on a port side or a starboard side of the vessel toward a bow of the vessel, the second vessel support structure is located on the same side of the vessel as the first vessel support structure toward a stern of the vessel, a distance between the first and second vessel support structures is (i) greater than a distance between the first vessel support structure and an end of the vessel at the bow and (ii) greater than a distance between the second vessel support structure and an end of the vessel at the stern, and the system restricts the vessel from rotating relative to a surface of the earth.

17. The system of claim 1, wherein:

the first vessel support structure is located on a bow of the vessel between a port side and a starboard side of the vessel, the second vessel support structure is located on a stern of the vessel between the port side and the starboard side of the vessel, and the system restricts the vessel from rotating relative to a surface of the earth.

18. The system of claim 1, wherein:

the first vessel support structure is located on a port side of the vessel, the second vessel support structure is located on a starboard side of the vessel, and the system restricts the vessel from rotating relative to a surface of the earth.

19. A system for securing a vessel floating on a surface of a body of water in a stabilized position, comprising:

a first vessel support structure and a second vessel support structure, each disposed on the vessel, each vessel support structure comprising:

one or more extension arms, each having a first end and a second end, wherein the first end of the one or more extension arms is suspended from the vessel support structure;

a weight connected to the second end of the one or more extension arms; and a yoke having a first end and a second end, the first end connected to the weight and the second end comprising a yoke head disposed thereon;

a first mooring support structure and a second mooring support structure, each fixed in place, and each mooring support structure comprising a pitch bearing, wherein:

the yoke head of the first vessel support structure is connected to the pitch bearing of the first mooring support structure, the pitch bearing of the first mooring support structure is configured to allow the yoke of the first vessel support structure to pivot about a horizontal axis relative to the first mooring support structure, the yoke head of the second vessel support structure is connected to the pitch bearing of the second mooring support structure, the pitch bearing of the second mooring support structure is configured to allow the yoke of the second vessel support structure to pivot about a horizontal axis relative to the second mooring support structure, and the system is configured to provide restoring forces between the first and second mooring support structures and the floating vessel in response to external environmental forces acting on the vessel.

20. A system for securing a vessel floating on a surface of a body of water in a stabilized position, comprising:

a first mooring support structure and a second mooring support structure, each fixed in place and comprising:

one or more extension arms, each having a first end and a second end, wherein the first end of the one or more extension arms is suspended from the mooring support structure;

a ballast tank connected to the second end of the one or more extension arms; and a yoke having a first end and a second end, the first end connected to the ballast tank and the second end comprising a yoke head disposed thereon;

a first vessel support structure and a second vessel support structure, each disposed on the vessel, and each vessel support structure comprising a pitch bearing, wherein:

the yoke head of the first mooring support structure is connected to the pitch bearing of the first vessel support structure, the pitch bearing of the first vessel support structure is configured to allow the yoke of the first mooring support structure to pivot about a horizontal axis relative to the first vessel support structure, the yoke head of the second mooring support structure is connected to the pitch bearing of the second vessel support structure, the pitch bearing of the second vessel support structure is configured to allow the yoke of the second mooring support structure to pivot about a horizontal axis relative to the second vessel support structure, and the system is configured to provide restoring forces between the first and second mooring support structures and the floating vessel in response to external environmental forces acting on the vessel.

* * * * *